US005800083A

United States Patent [19]

Gaarder et al.

[11] Patent Number: 5,800,083

[45] Date of Patent: Sep. 1, 1998

[54] MULTIPLE-FUNCTION PRINTER DOCUMENT DEFLECTOR ACTUATION COUPLED TO SERVICE STATION ACTUATION

[75] Inventors: Glenn W. Gaarder, Ramona; Samuel A. Stodder, Encinitas; Lynn D. Palmer, Escondido; Dan S. Caputo; Chan K. Nguyen, both of San Diego, all of Calif.

[73] Assignee: Hewlett-Packard Co., Palo Alto, Colo.

[21] Appl. No.: 724,297

[22] Filed: Sep. 19, 1996

[51] Int. Cl.[6] ..... B41J 23/34

[52] U.S. Cl. ..... 400/185; 400/605; 400/624; 358/296; 347/22; 347/104

[58] Field of Search ..... 400/185, 187, 400/605, 607, 624, 625, 629, 701; 358/296; 347/22, 29, 32, 33, 101, 104; 271/209

[56] References Cited

U.S. PATENT DOCUMENTS

| | | | |
|---|---|---|---|
| 4,511,904 | 4/1985 | Takahashi | 346/134 |
| 4,729,683 | 3/1988 | Staniszewski | 400/624 |
| 4,802,778 | 2/1989 | Takahashi et al. | 400/624 |
| 5,124,800 | 6/1992 | Hashimoto | 358/296 |
| 5,162,916 | 11/1992 | Stemmle et al. | 358/296 |

*Primary Examiner*—David A. Wiecking

[57] ABSTRACT

A multiple-function printing device provides for picking pages from a stack of sheets in an input feeder for roller-driven movement along a first path through a printing station to an output, and for picking pages from a stack of documents in an input feeder for roller-driven movement along a second path through a scanning station to an output, with at least a portion of the first and second paths being commonly shared, with a document deflector which, in a document scanning mode of operation, is pivoted into a lowered position generally parallel to a print station platen to constrain the top and bottom of curled documents exiting from the scan station so as to prevent an incipient paper jam. The deflector is actuated by a drive mechanism including a ball link and cranks connected to a common motor in a service station for capping and wiping print cartridges in the printing station.

23 Claims, 26 Drawing Sheets

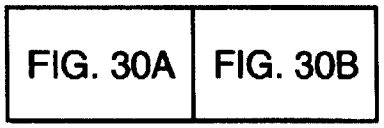
FIG. 30
FIG. 30B
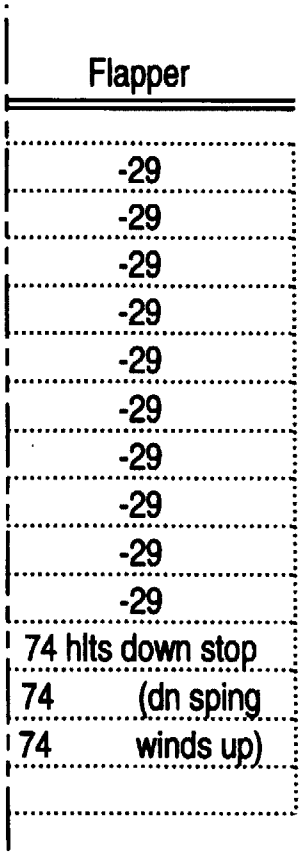

| Event | Cam & 13T Gear | Stepper Motor # Steps | Cam Radius | 16T Gear | Keeper & Btm Crank | Flapper Follower |
|---|---|---|---|---|---|---|
| Initialization - Down | -10 | 0 | 5.5 | -8.125 | 0 | 10.7825 |
| Rest Position | 0 | 16 | 5.5 | 0 | 0 | 10.7825 |
| Start Wipe Rise | 10 | 32 | 5.5 | 8.125 | 0 | 10.7825 |
| Wipe Up | 150 | 256 | 10 | 121.875 | 0 | 10.7825 |
| Wipe Up Nominal Position | 160 | 272 | 10 | 130 | 0 | 10.7825 |
| Start Rise to Cap | 170 | 288 | 10 | 138.125 | 0 | 10.7825 |
| Cap Up | 350 | 576 | 15.1 | 284.375 | 0 | 10.7825 |
| Cap Up Nominal Position | 355 | 584 | 15.1 | 288.4375 | 0 | 10.7825 |
| Start Flapper Follower Down | 360 | 592 | 15.1 | 292.5 hlts keeper | 0 | 10.7825 |
| Start Flapper Down | 367.4268 | 603.88576 | 15.1 | 298.5357375 | 6.0357375 | 13.5 hlts dn sprng |
| Flapper Down | 534.4604 | 871.13664 | 15.1 | 434.249075 | 141.749075 | 116.5 |
| Flapper Down Nominal Position | | | 15.1 | | | |
| Initialization - Up (Bttm Crank) | 552 | 899.2 | 15.1 | 448.5 | 156 hlts end stop | 124.4771 |
| End of Travel - Cam | 586.3 | 954.08 | 15.1 | 476.36875 | Not Possible | Not Possible |

FIG. 30A

MULTIPLE-FUNCTION PRINTER DOCUMENT DEFLECTOR ACTUATION COUPLED TO SERVICE STATION ACTUATION

BACKGROUND OF THE INVENTION

This invention relates generally to printers and facsimile devices, and more particularly to printers and facsimile devices and their operation which are combined together to form a multiple-function product.

Facsimile devices (i.e., fax machines) have been used for many years to transmit documents containing text or graphical images through a modem via telephone lines through another modem to a remote destination. In its basic form, a conventional fax machine is used for three separate functions: sending a first document; receiving a second document; and producing a hardcopy printout of the second document. Of course the hardcopy printout is not the actual second document but rather a close facsimile thereof. Thus, sending the contents of the second document via fax avoids going to the trouble, expense and delay of actually delivering the second document to a remote destination.

An enhanced fax machine can also be used to perform two additional functions: producing a hardcopy printout of the first document; and producing a hardcopy printout of a cumulative report showing an itemized listing of date, time, and destination for first documents sent from the fax machine.

It is therefore apparent that a fax machine acts primarily as both a sender (i.e., scanning and transmitting) and receiver of documents, and that the fax machine also acts secondarily as a printer (i.e., printing a facsimile of a second document, printing a copy of a scanned first document, or printing an itemized report) and secondarily as a convenience copier (i.e., scanning/printing a first document).

Both the basic fax machine and the enhanced fax machine just described have used two separate paper paths. One path is dedicated to the first document and typically includes document feeder tray, document paper pick/paper drive system, document scanning station, and document output. Another path is dedicated to the printout (originally roll-fed, now sheet-fed) and typically includes sheet feeder tray, sheet paper pick/sheet drive system, sheet printing station, and sheet output. As a result, a fax machine is a bulky, expensive multiple-function device which requires a large number of parts for duplicate paper handling functions.

BRIEF SUMMARY OF THE INVENTION

It is an object of the present invention to provide a fax machine with common feeder/output mechanisms for documents passing through a scanning printing station and for sheets passing through a printing station.

Another important object is to provide a multiple-function printer/fax machine which is primarily a printer peripheral for a computer as well as primarily a fax machine, having integrated shared paper path and common mechanisms for scanning documents on the one hand and for producing hardcopy printout sheets on the other hand.

When using a common paper path for scanning and printing, media that feeds through the device can range from original sheet stock to highly curled, bent or otherwise deformed documents. Provisions are made in this invention to properly move the media from roller to roller without incurring paper jams. Sheet media for printing is typically in good form and does not always require a paper path constraint on both faces of the paper. For a translating carriage type printer (i.e. typical inkjet printer), the space above the paper in the printing region is used for moving the print cartridge across the paper in close proximity. Documents for scanning can be in bad form and have been found to require top and bottom face constraint throughout the paper path. Thus, this invention includes a means to constrain both faces of documents which pass through the print region and when printing on original sheet stock does not interfere with the print cartridge.

This improvement includes a document guide or deflector/flapper located above the paper path in the printing area which guides the document into the output roller nip. The document guide allows for deformed documents to be reliably moved through a common paper path multi-function printer. This results in a lower cost multi-function printer without compromising the reliability of the document feeding function.

A further object is to provide a multiple function machine having a single drive motor in a service station for performed both capping and wiping of printheads of print cartridges for printing on paper sheets; and for operating a document guide for constraining a surface of document pages exiting from a scanning station to an output station.

In another aspect of the invention since the single drive motor has a shaft which is non-intersecting and non-parallel to the document deflector (flapper) a transfer of rotation is provided using an improved ball and crank linkage. Another feature of the invention allows a user to manually rotate the document deflector up or down without damage to the drive train from the motor to the document deflector. Further, a cam and cam follower are provided in the drive train which include various pre-travel and post-travel dwells to account for example tolerances and misalignments of the various parts. Stepper motor noise has been virtually eliminated by means of an innovative stepper motor initialization algorithm as well as proper alignment of the assemblies. In one embodiment a down spring is provided and positioned to ensure that no torque is imposed on the arm of the deflector ensuring that the arm will not creep.

BRIEF DESCRIPTION OF THE DRAWINGS

FIG. 30 is a timing chart for the cam follower and cam for service station operation and document deflector (flapper) actuation.

DETAILED DESCRIPTION OF THE PREFERRED EMBODIMENTS

Generally speaking, the invention provides for picking pages from a stack of sheets in an input feeder for roller-driven movement along a first path through a printing station to an output, and for picking pages from a stack of documents in an input feeder for roller-driven movement along a second path through a scanning station to an output. Depending on the particular implementation, at least a portion of the first and second paths are commonly shared, and common mechanisms are used for various steps such as for picking, providing roller-driven movement through the processing stations, and for actuating a pressure plate in the input feeders.

Figure 1:
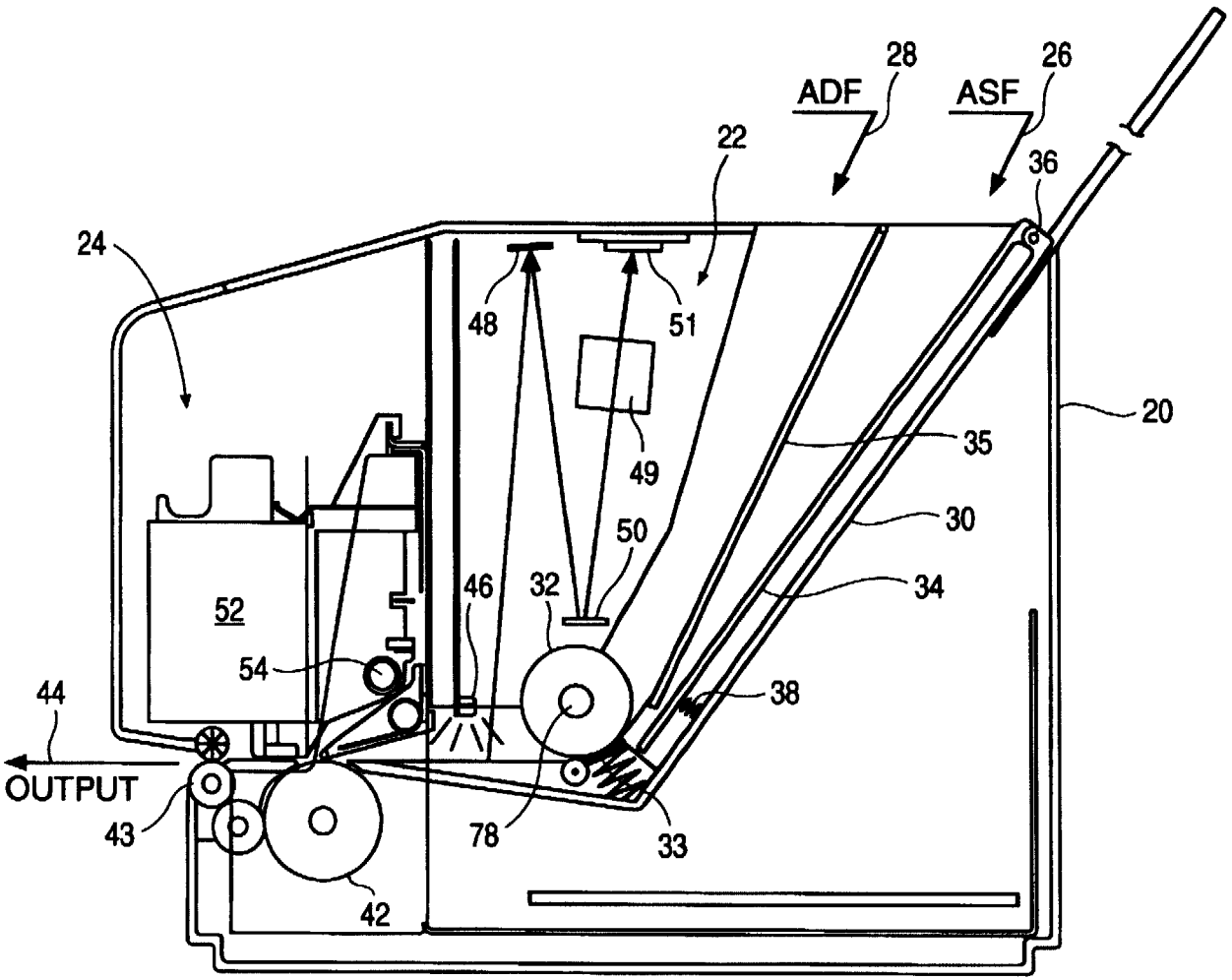
FIG. 1 is a schematic side view of a presently preferred printer/facsimile embodiment of the present invention.
Figure 2:
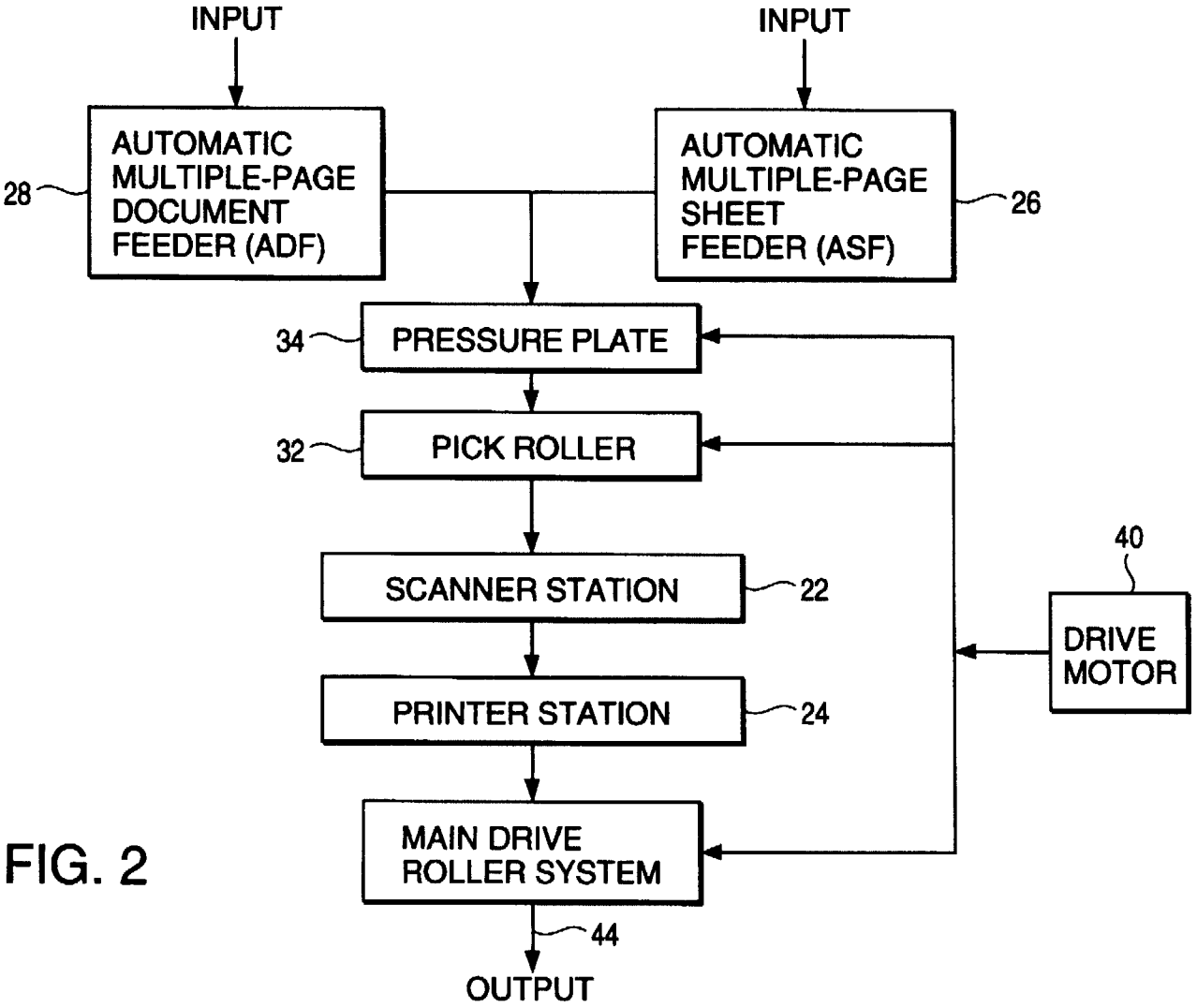
FIG. 2 is a functional block diagram of the embodiment of FIG. 1.
Figure 8:
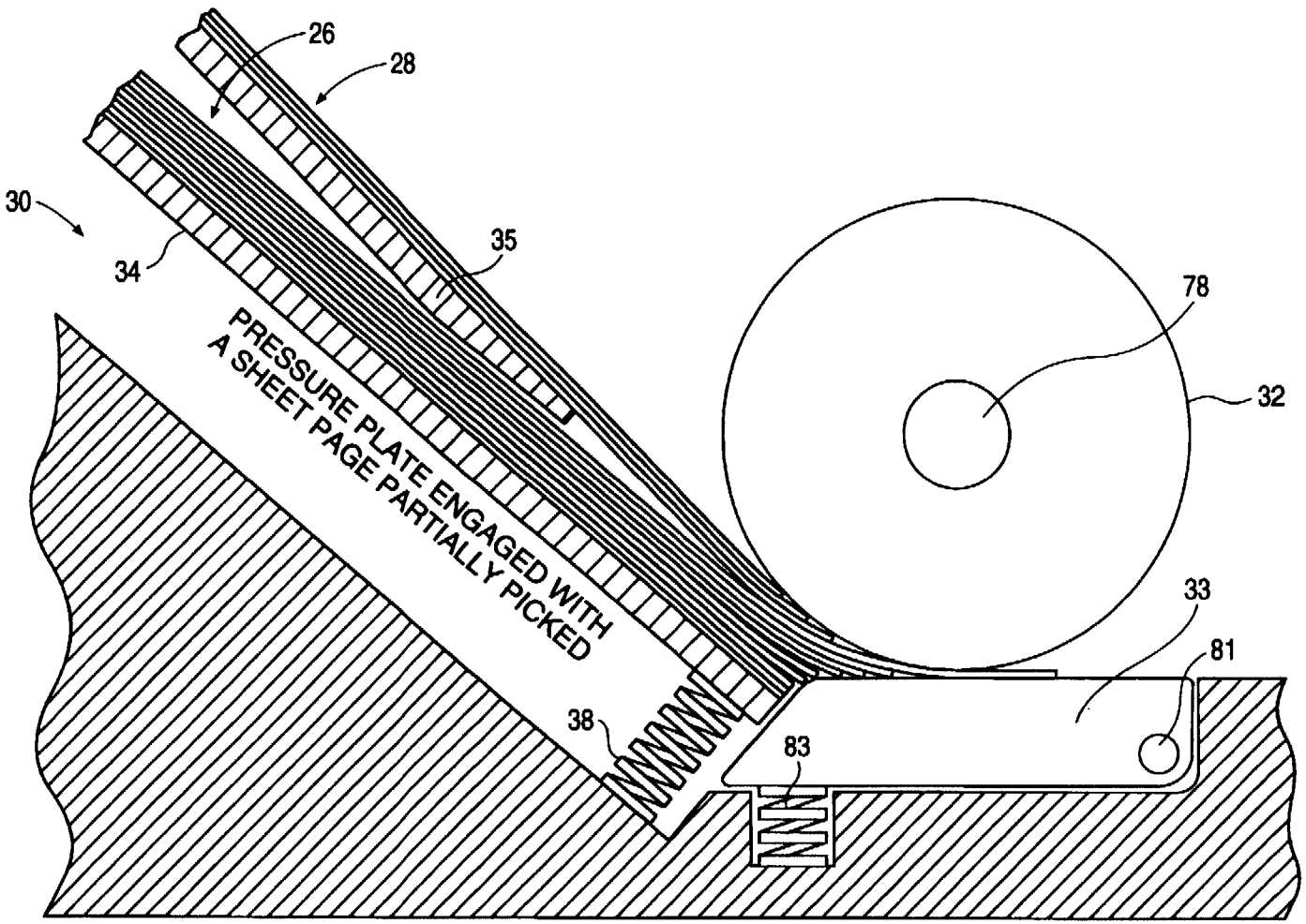
FIG. 8 is a close-up schematic showing a pick roller ready to begin a reverse rotation kicking partially picked sheet(s) backward into the ASF as a result of a document stack being inserted into the ADF.
Figure 9:
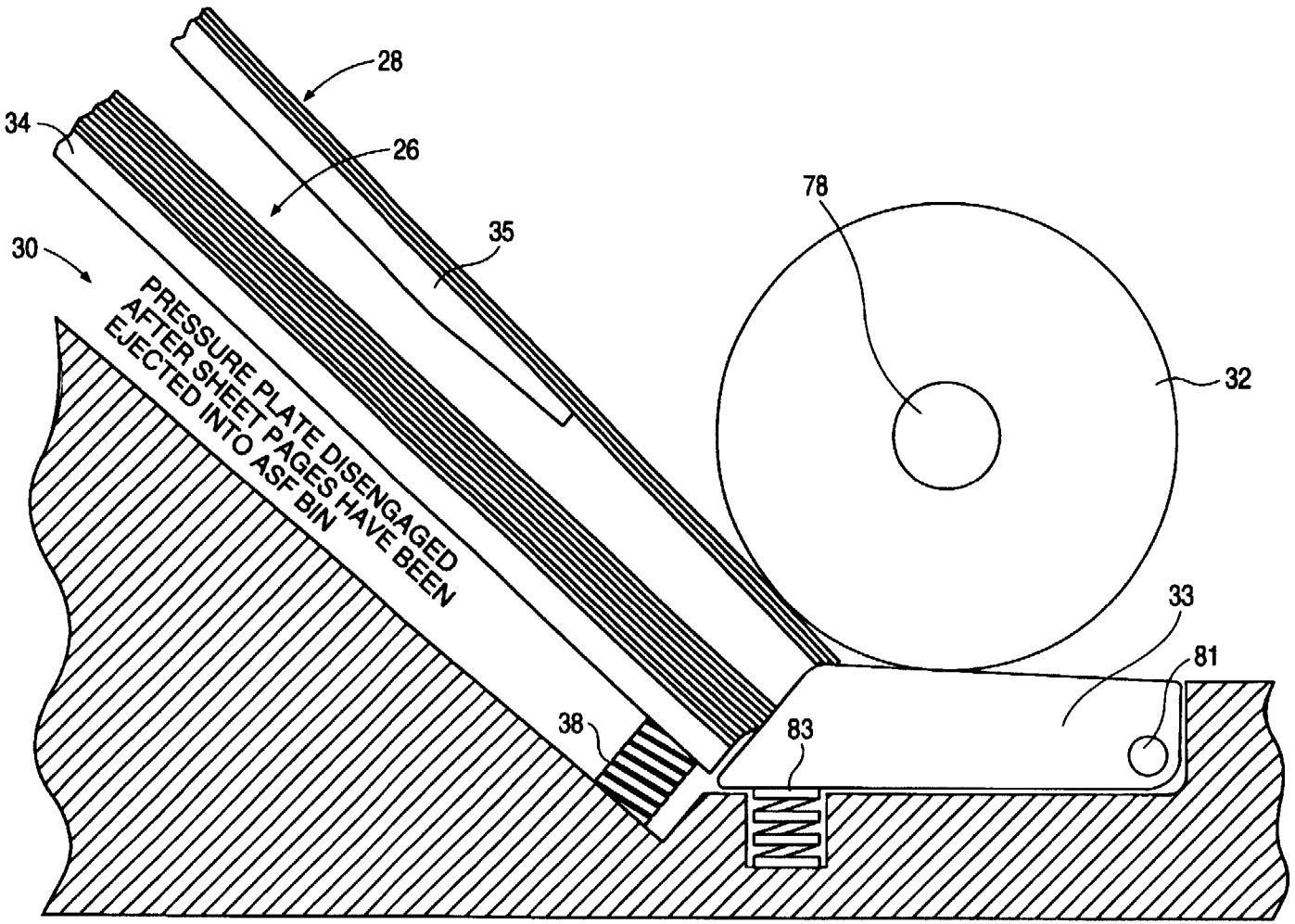
FIG. 9 is a close-up schematic showing the pressure plate in disengaged position and all of the partially picked sheets expelled from underneath the pick roller into the ASF.
Figure 10:
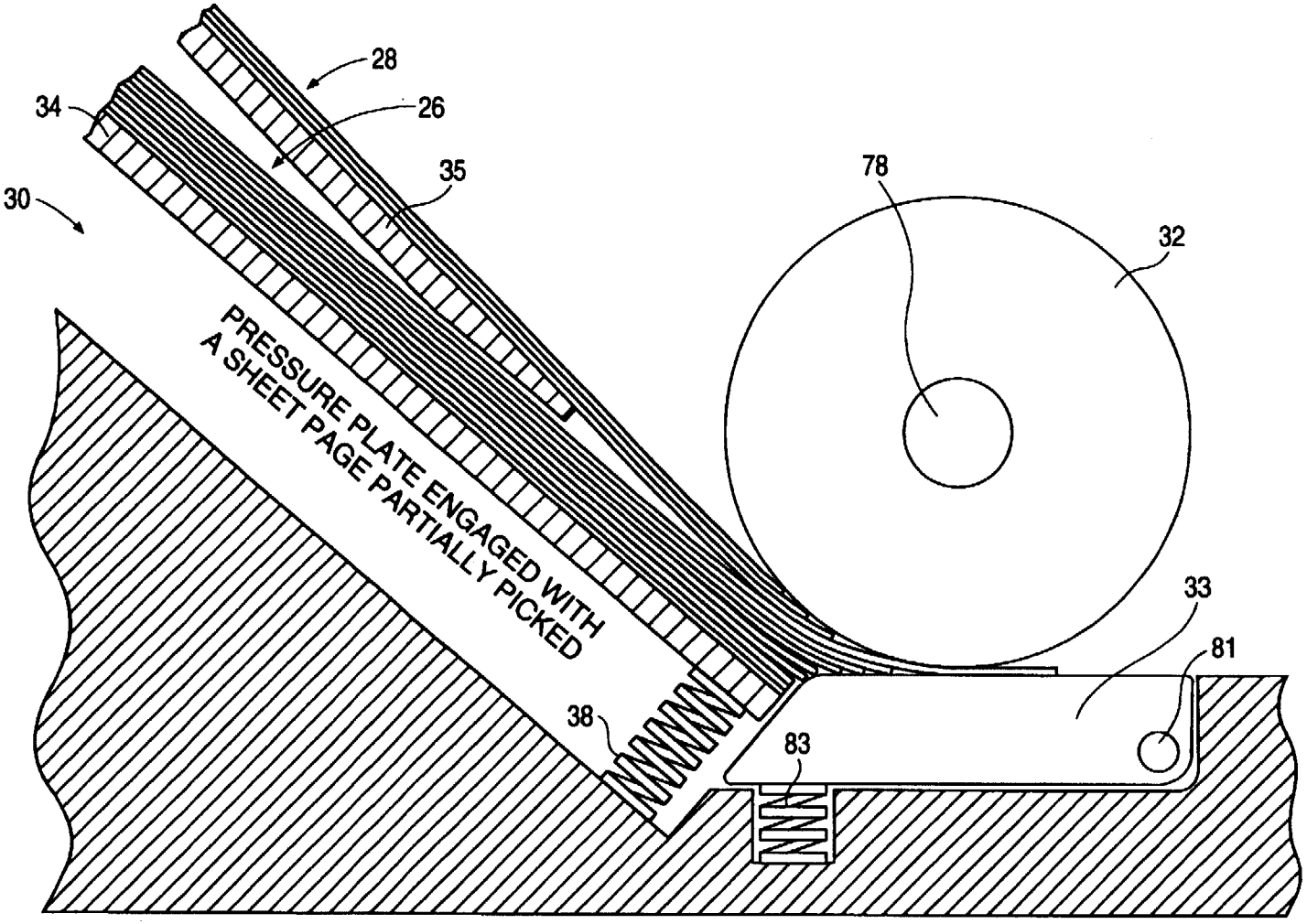
FIG. 10 is a close-up schematic showing the pressure plate returned to an engaged position with the pick roller already commencing to pick a page from the top of the stack of documents which now partially overly the stack of print sheets.

Referring more particularly to FIGS. 1–2, the multiple-function device of the presently preferred embodiment includes a frame 20 for housing a scanner station 22 and a printer station 24. A stack of print sheets is loadable into an automatic sheet feeder (ASF) 26, and a stack of documents having text/graphics to be scanned is loadable into an automatic document feeder (ADF) 28 which together form a common input feeder slot 30 having a pick roller 32 and a spring-loaded stripper pad 33 at the lower end. The upper portion of the input feeder slot which constitutes the ADF is separated from the ASF by a divider 35. The divider is truncated at its lower end to allow document stacks and sheets stacks to converge at the pick roller (see FIGS. 8–10). A pressure plate 34 is attached at its upper end through pivot pin 36 to the frame and is normally biased upwardly against the pick roller by springs 38. A drive motor 40 (FIG. 2) is connected through a gear mechanism to the pressure plate 34 and pick roller 32 as described in more detail hereinafter, and is also connected to a main drive roller 42 which pulls the pages through the processing stations for either scanning or printing. The printout pages as well as the scanned pages pass across an output roller 43 to be deposited in a common output area 44.

The scanner and printer stations in the drawings are for purposes of illustration only and are of conventional design, except for their unique locations along a shared path using shared mechanisms. In that regard, scanner station 22 includes a lamp 46 for illuminating a scanning zone, reflective mirrors 48, 50, a lens 49, and a CCD (charge-coupled device) photosensor 51. Printer station 24 includes inkjet cartridge 52 which rides on a slider rod 54 back and forth across a print zone.

Figure 11:
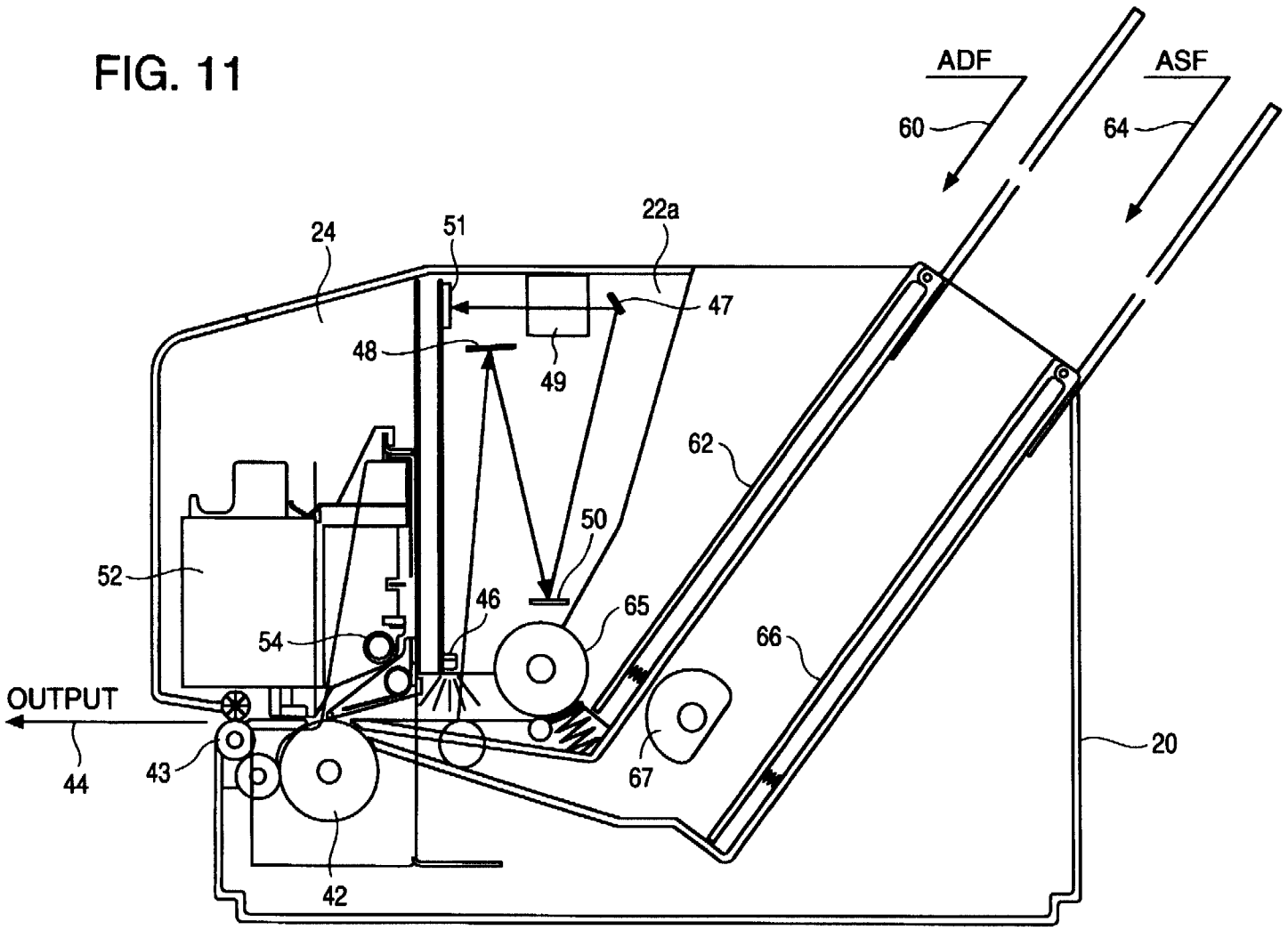
FIG. 11 is a schematic side view of an alternate printer/facsimile embodiment of the present invention.
Figure 12:
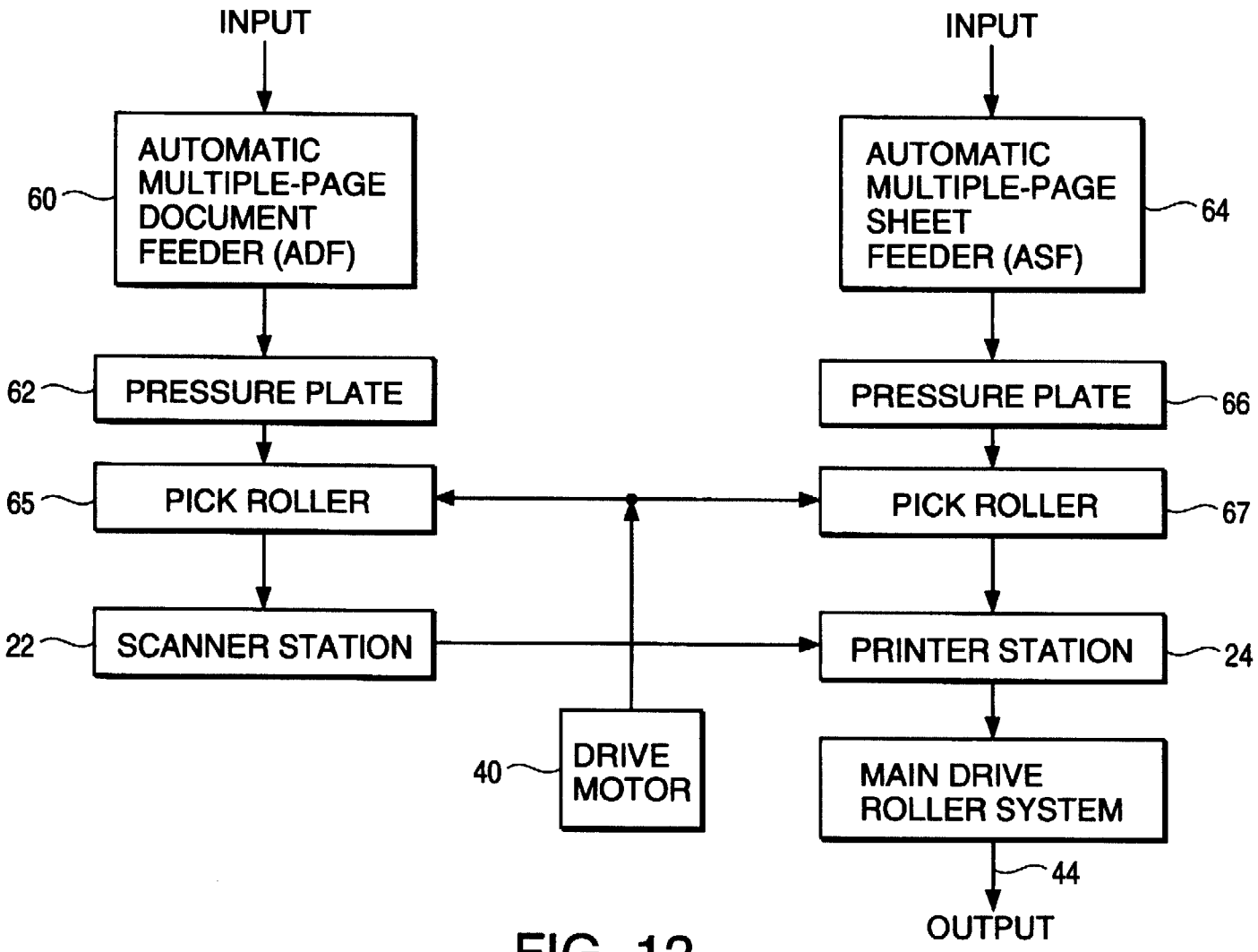
FIG. 12 is a functional block diagram of the embodiment of FIG. 11.

In the alternate embodiment of FIGS. 11–12, the common document/sheet path and shared mechanisms are similar to FIGS. 1–2 and include scanner station 22*a*, printer station 24, drive motor 40, main drive roller 42, output roller 43 and a shared output 44 wherein document pages proceed actively through the scanner station and passively through the printer station, and printout sheet pages bypass the scanner station and proceed actively through the printer station, both to a common output. However, ADF 60 has its own pivotally mounted spring-loaded pressure plate 62 to facilitate reliable page feeding to document pick roller 65, and ASF 64 has its own pivotally mounted spring-loaded pressure plate 66 to facilitate reliable page feeding to sheet pick roller 67, with both pick rollers 65, 67 being driven by the drive motor 40.

Figure 13:
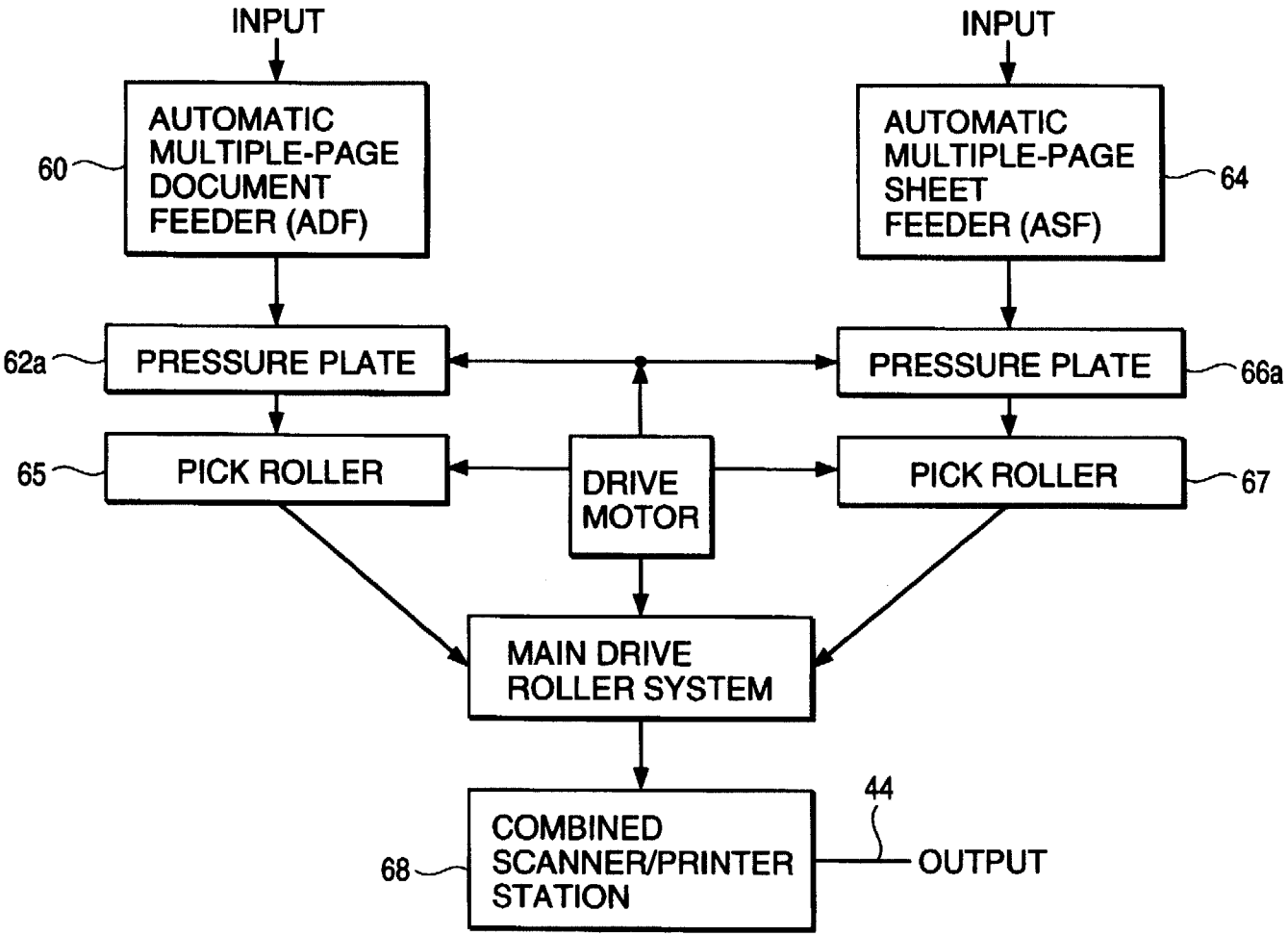
FIG. 13 is a functional block diagram of another alternate printer/facsimile embodiment of the present invention.

In another alternate embodiment of FIGS. 1–2, the common document/sheet path and shared mechanisms are similar to FIGS. 11–12. But this alternate embodiment (FIG. 13) provides a common path through a combined scanner/printer station 68 to a common output 44, with separate pick rollers 65, 67 and separate pressure plates 62*a*, 66*a* driven by the drive motor 40 for the main drive roller system.

Referring now to FIGS. 3–6 which show further details of the preferred embodiment of FIGS. 1–2, the input feeder slot is integrated into the device so that when the unit is resting with its feet 69 on a desk top, stacks of sheets or documents can be added without having to remove any tray. Since the frame is supported by legs 71 so that the input feeder slot is angled downwardly, both of the stacks naturally settle to the bottom of the slot so that the leading edges of pages on top of the stacks will impinge against the pick roller (see FIGS. 8–10). The action of the pressure plate against both stacks assures proper separation by the spring-loaded stripper pad 33 in combination with the rotation of the pick roller 32.

The ADF includes an extender 70 mounted on the upper end of the divider 35 which pivots forwardly out of the way when pages are added or removed from the ASF. The ASF is sandwiched between the ADF and the bottom of the feeder slot and includes its own extender 72 as well as a single adjustable guide 74 for maintaining the sheet stack in proper positioning for feeding into the pick roller.

It will be understood by those skilled in the art that proper feeding/picking of pages from a large quantity stack of virginal printing paper in the ASF is a somewhat easier task than proper feeding/picking of variously sized partially bent pages of stacked documents in the ADF having text/graphics thereon. Therefore the ADF is positioned above the ASF for better picking by the pick roller and easier access for accurate and proper loading between dual adjustable guides 76. The automatic action of the pressure plate 34 as described in more detail hereinafter also helps to ensure proper feeding of pages from the ASF for printing or pages from the ADF for scanning.

The pick roller 32 is mounted on a pick shaft 78 which has a pair of guide rollers 80 also mounted thereon in the commonly shared paper path, as well as a double-pin delay coupler 81 mounted on the shaft end outside the frame. The guide rollers 80 and matching pinch rollers 82 help to hold the pages in proper position as they move past the pick roller to the scanning and printing stations.

Figure 3:
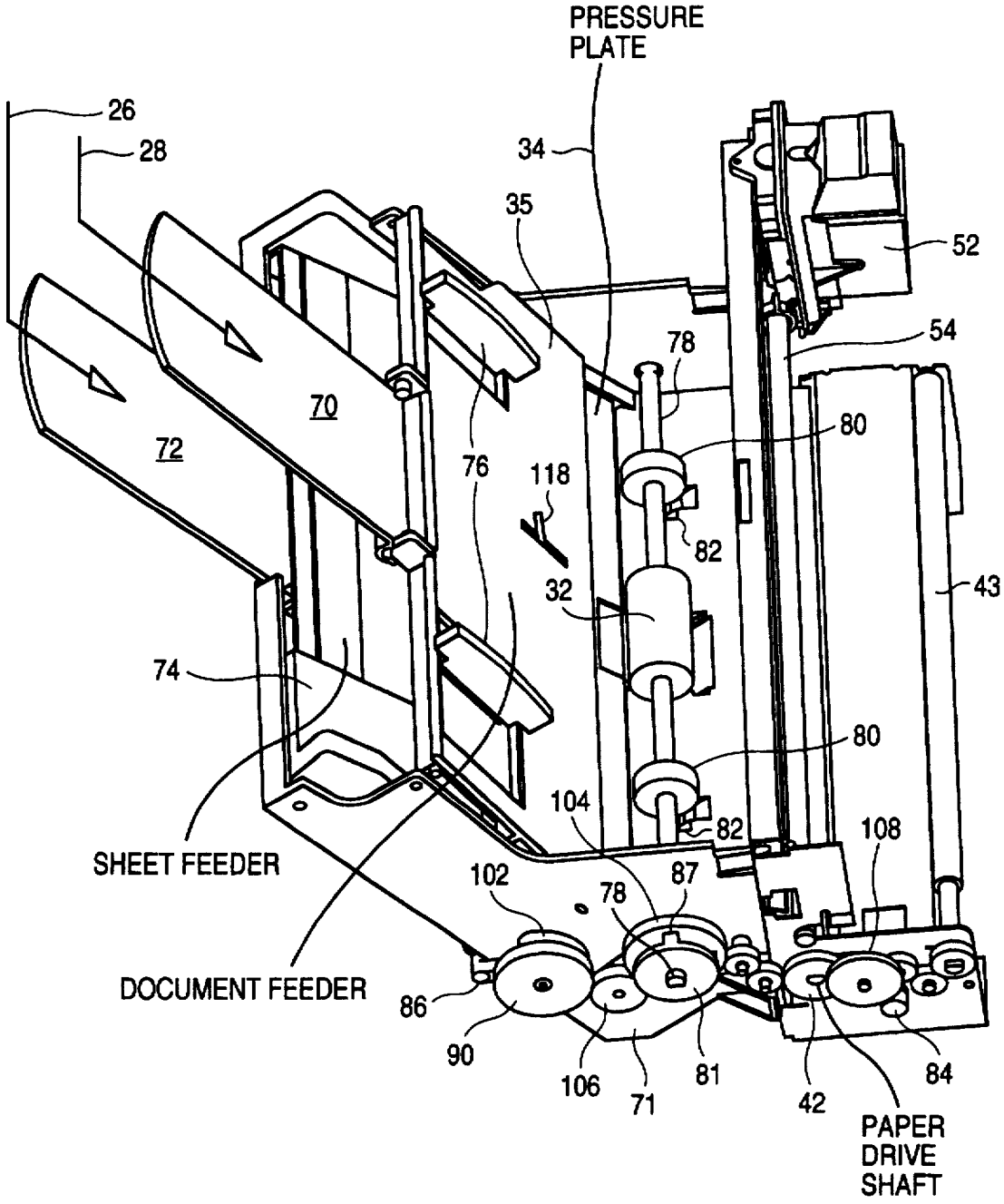
FIG. 3 is an isometric view looking down into an implementation of the embodiment of FIG. 1.
Figure 4:
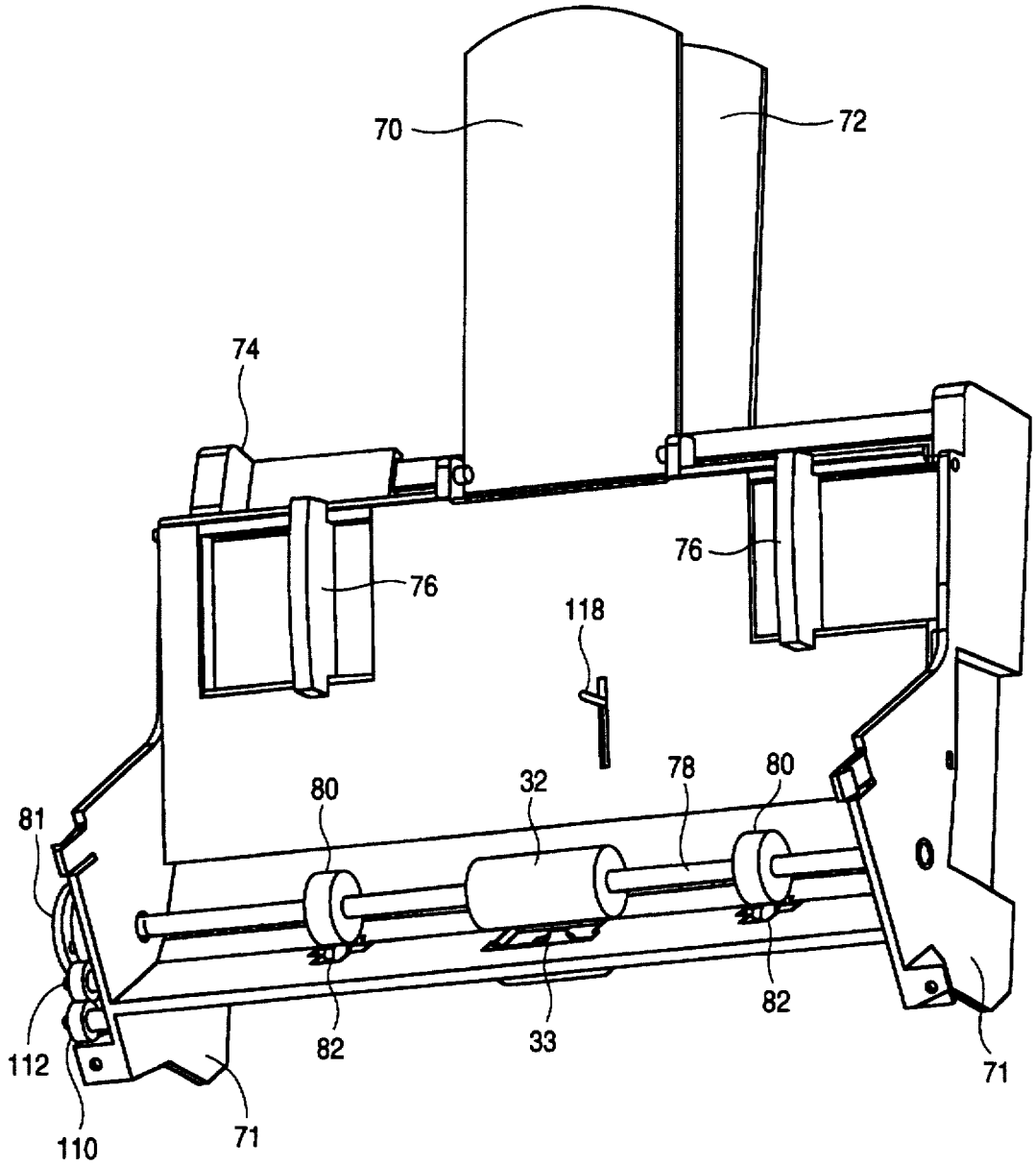
FIG. 4 is a fragmentary isometric view showing the input feeder slots and pick roller portion of FIG. 3.
Figure 5:
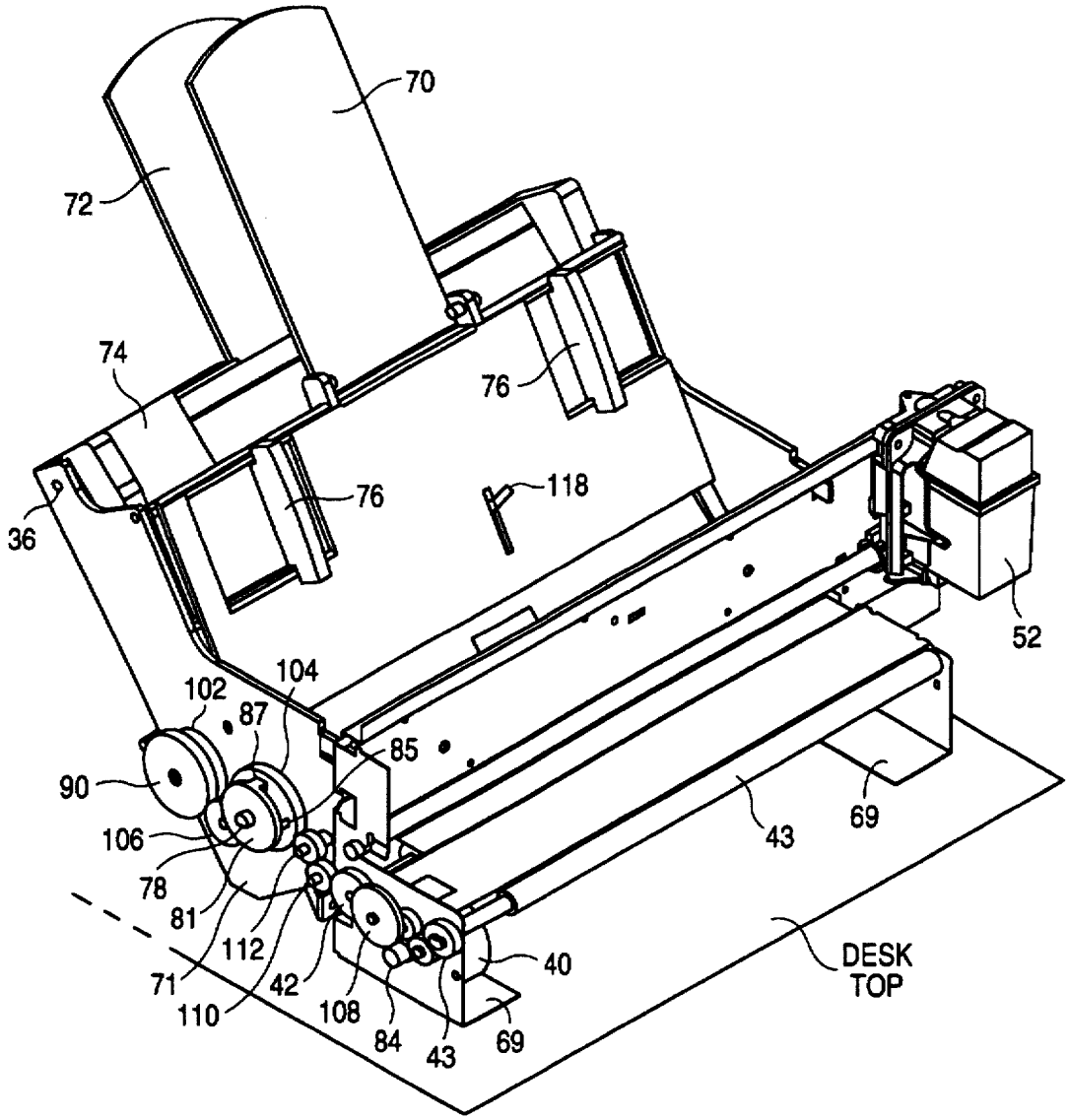
FIG. 5 is a front isometric view of FIG. 3.
Figure 6:
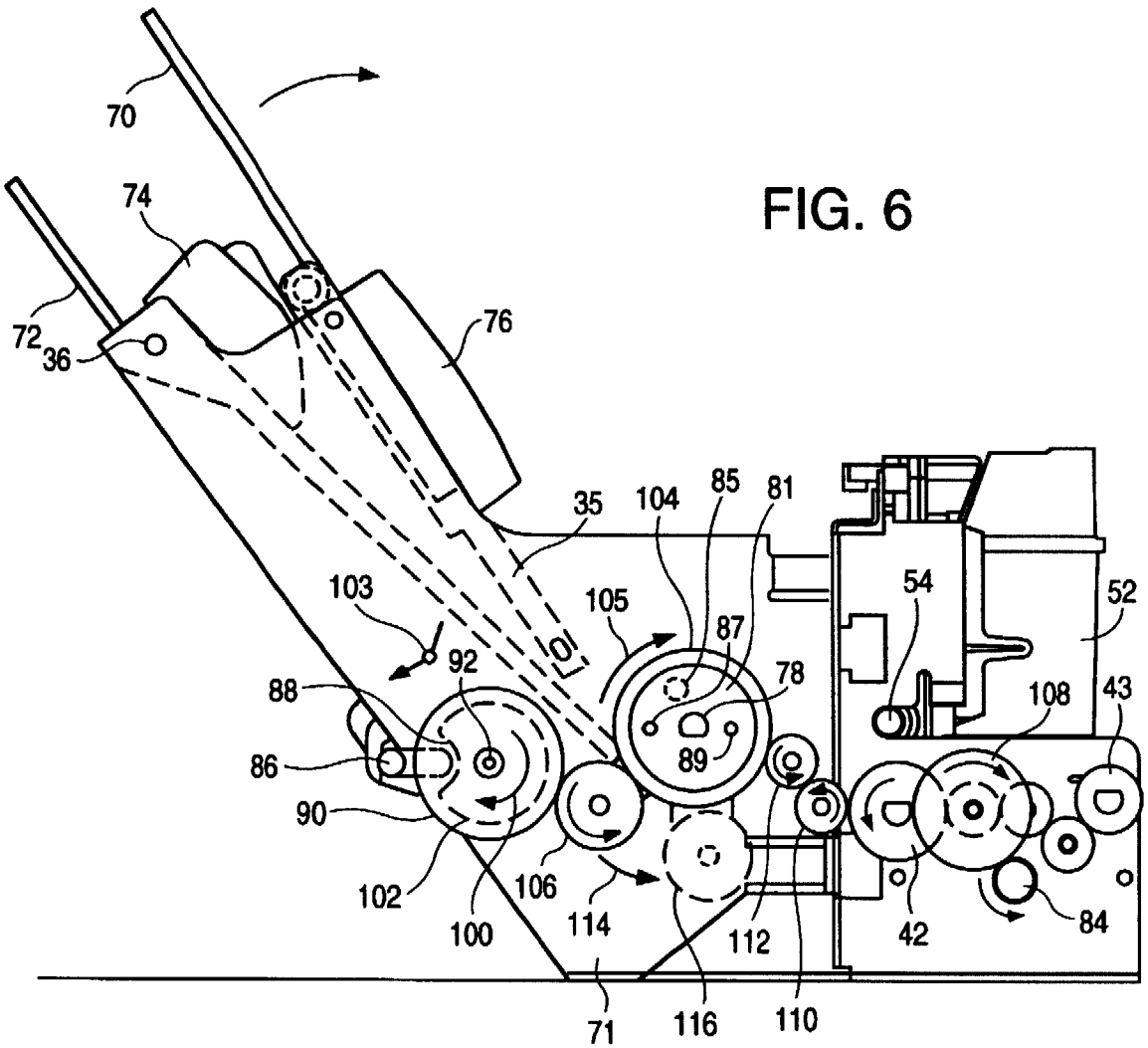
FIG. 6 is a side view of FIG. 3.
Figure 7:
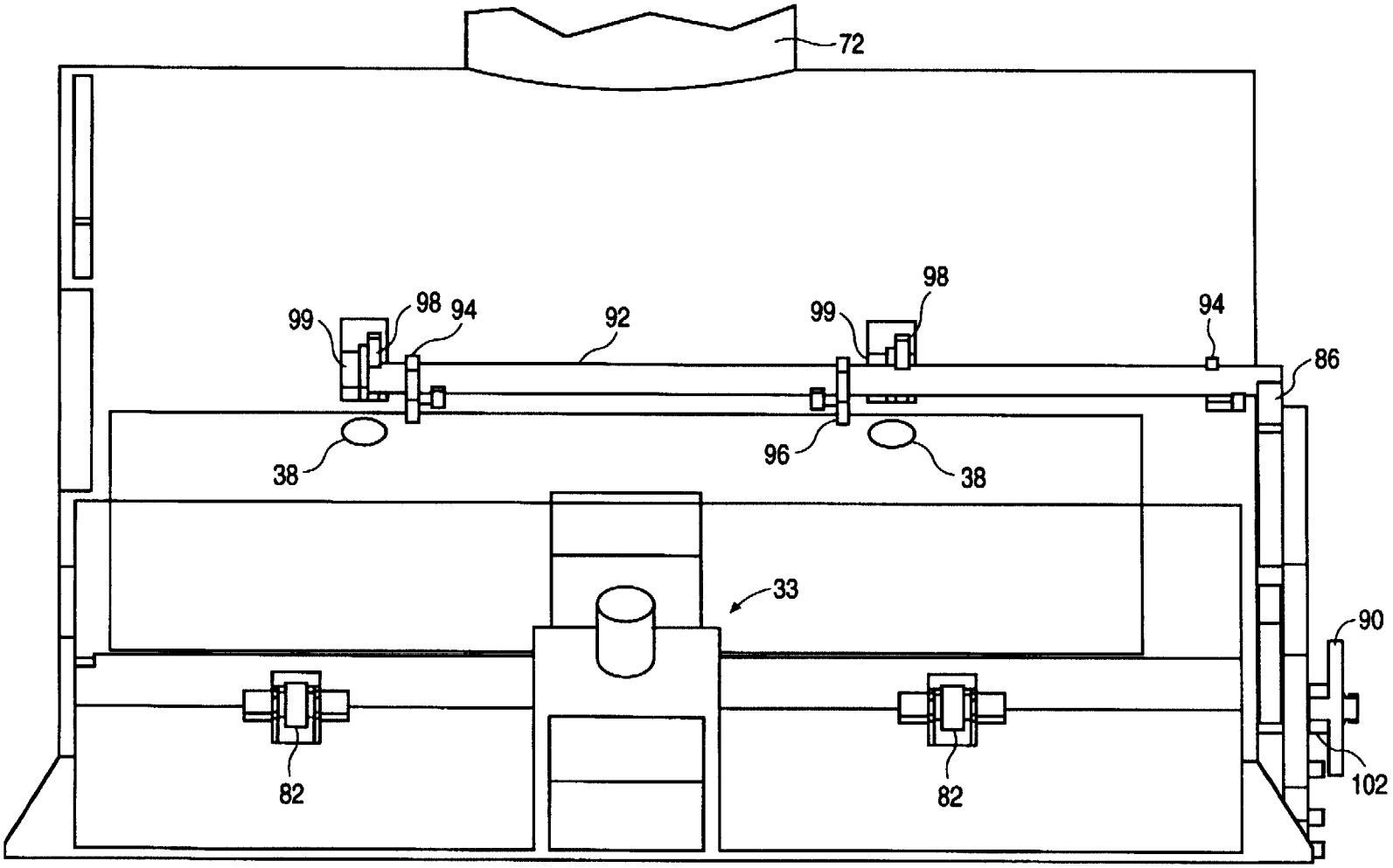
FIG. 7 is a fragmentary back view looking up at the feeder slots and pick roller portion of FIG. 4.

A unique gear mechanism is shown in FIGS. 3 and 6–7 for automatically moving the pressure plate to and from between a disengaged position "open" position and an engaged "closed" position. The disengaged open position allows access to the stacks for removal, replenishment, or replacement of pages as well as for realignment of the stacks between one or more page picking events if that is deemed to be desirable and necessary to avoid mis-feeds. More importantly from a multiple-function point of view (see FIGS. 8–10), the disengaged open position allows new pages of documents to be placed in the ADF with their leading edges resting on top of the sheet stack in the ASF, thereby preparing for a scanning operation to commence.

The engaged closed position holds the sheet stack in aligned position together as a unit if there are not any documents in the ADF. This helps to prevent more than one page from being accidently picked. The engaged closed position holds the document stack in aligned position together as a unit if there are not any sheets in the ASF. If there is already a stack of sheets in the ASF and some additional document pages have been added to the ADF, then the engaged closed position holds both the document stack and the underlying sheet stack in aligned position together as a composite stack insofar as their leading edges are concerned.

FIG. 6 shows the gear mechanism in a "start disengagement" position, with motor drive gear 84 moving in reverse direction to cause main drive roller 42 to also go in reverse. Coupling pin 85 on linkage gear 104 is partway between forward direction coupling pin 87 and rearward direction coupling pin 89 on delay coupler 81. This ensures that commencing the reverse driving of the pick roller to expel partially picked pages does not occur until after the pressure plate has been moved into disengagement position.

Cam follower 86 is resting in a notch on cam 88 which is rigidly mounted for turning with pressure plate gear 90. So long as cam follower 86 remains in the notch, the pressure plate remains in closed engagement position. The connection between cam follower 86 and the pressure plate is best shown in FIG. 7. The cam follower 86 is mounted on the end of a pivot rod 92 which is mounted for pivotal rotation by a pair of brackets 94 and a counter-bracket 96. A pair of fingers 98 are also mounted on pivot rod 92 and interconnect with matching slots 99 so that when the pressure plate gear 90 is rotated in direction 100, the cam follower is forced to pivot upwardly into "disengagement position" and ride along the larger diameter surface 102. This makes the entire pivot rod 92 rotate and causes the fingers 98 to pivot the pressure plate 34 in direction 103 into a completely retracted position of disengagement in a direction away from the pick roller 32. When the pressure plate gear 90 has made a complete rotation, the cam follower rides back down into the notch, thereby allowing the pressure plate to return to an "engagement position".

A linkage gear 104 is slidably mounted on the pick shaft 78 to couple the drive motor 40 to the pressure plate gear 90, and also to couple the drive motor 40 through the double-pin delay coupler 81 to the pick roller. When the motor drive gear 84 is in reverse, the linkage gear rotates in direction 105 to move its attached transfer gear 106 into link position with the pressure plate gear 90. Thus the coupling from drive motor 40 to the pressure plate gear 90 is through double-wheel gear 108, main drive gear 42, spur gears 110, 112, linkage gear 104, and transfer gear 106. Decoupling occurs when the motor drive gear 84 changes back to forward, since this changes the rotation direction of linkage gear 104 and moves transfer gear 106 in the direction 114 to a non-link position 116. The foregoing gear/cam mechanism provides for automatic movement of the pressure plate between a position of engagement of the stacks with the pick roller and a position of dis-engagement. This necessarily occurs after a page being processed at the scanning station or the printing station has passed by the main drive roller 42 and the output roller 43 to the common output area 44.

The initiation of the dis-engagement can be programmed to occur at predetermined times such as before every picking step, or whenever a mis-feed occurs, or the like. Also, when a document page is placed in the ADF, it pushes down sensor 118 to activate the aforementioned dis-engagement sequence of steps.

As best shown in FIG. 6, the delayed contact of the pin 85 on linkage gear 104 with double-pin delay coupler 81 causes the reversing of the pick roller expelling any pages from a previous picking step to occur after the pressure plate has moved to a position of dis-engagement.

As best shown in FIG. 6, the gearing mechanism is designed to automatically provide a delay between the picking of successive pages from the sheet stack or document stack. In that regard, the gearing ratios provide for output roller 43 to rotate faster than main drive roller 42 which rotates faster than pick roller 32. The speed differential between the output roller 43 and the main drive roller 42 keeps a page in tension as it passed through the printing station, the scanning station, or the combined printing/scanning station.

The linkage gear 104 has its single pin 85 which engages one or the other of the two pins 87, 89 on the delay coupler 81 (depending on the direction of the main drive) to drive the pick roller forwardly or rearwardly with a partial revolution delay for driving the pick roller when a directional change occurs. This relationship between the linkage gear 104 and the delay coupler 81, when combined with the speed differential between the pick roller 32 and the main drive roller 42, provides for the pin on the linkage gear 104 to walk away from engagement of the pin on the delay coupler so long as a page is in driving engagement with both the pick roller and the main drive roller. In other words, during that double driving period, the pick roller is slaved to the paper and rotates faster than the linkage gear to cause the aforesaid "walk away".

When the trailing edge of the page finally leaves the pick roller, the pick roller shaft and the delay coupler mounted thereon stop, and the time it takes for the pin on the linkage gear to rotate into engagement with the pin on the delay coupler is the "delay time" which occurs between the picking of successive pages from the stack.

Thus, the aforementioned features of the present invention provide for automated operation of a printing station, scanning station or the like from a single drive motor through a gear mechanism which provides spaced-apart picking of successive pages from an input feed stack. These aforementioned features also provide for the shared use of a paper path and mechanisms which are involved along the path by a multiple-function device which employs operations such as printing, scanning and the like in the same machine.

Figure 14:
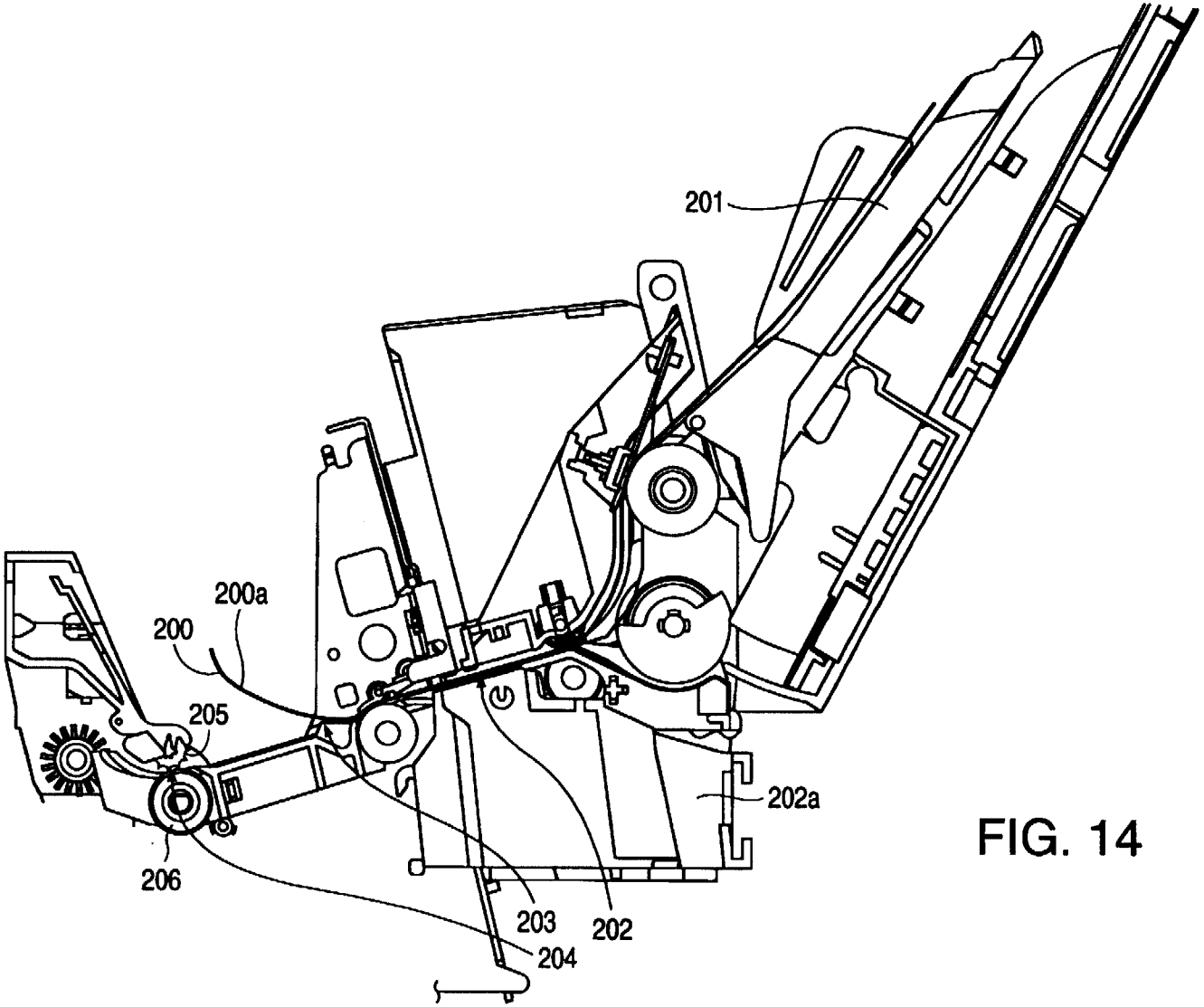
FIG. 14 is a more detailed schematic side view of the common paper path of the invention illustrating the common path with a curled document positioned immediately prior to an incipient paper jam at the output roller nip.

FIG. 14 illustrates the curling of a document 200 after the document has been fed from a document feeder 201 past a scanning station 202, including a scanner 202*a*, where it has been scanned, passively over a printing station 203 (sans print cartridge which has slid away from the print zone) which document was destined to be conducted into a nip 204 between output rollers 205 and 206. As a curled document exits the scan station and enters the print region it is free to return to its natural curled state. Due to the curling of the document at 200*a*, the document is in an incipient position to cause a paper jam before reaching the nip 204.

Figure 15:
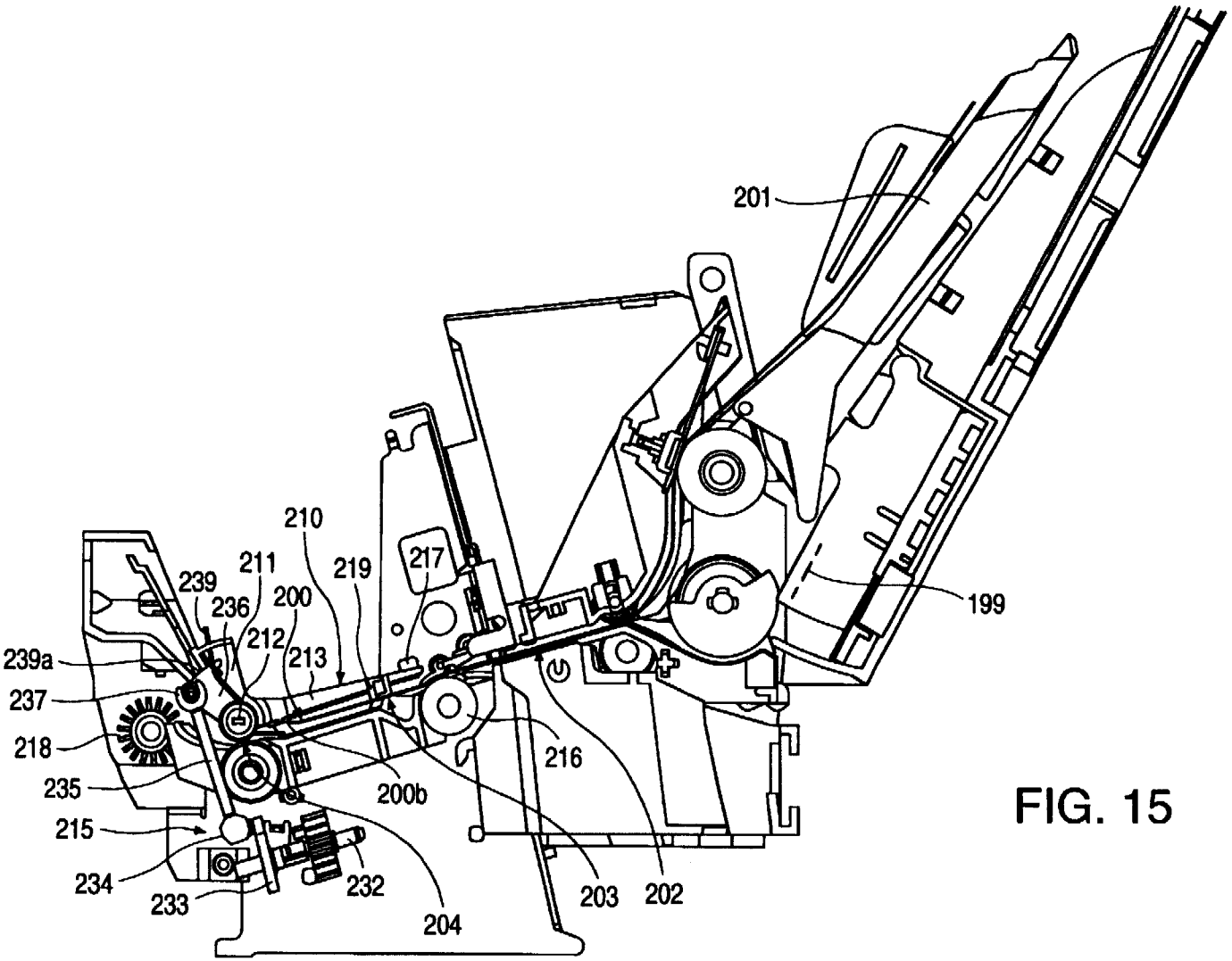
FIG. 15 is a schematic side view of the common paper path showing a jam-preventing document guide in a lowered position.

FIG. 15 shows the addition of a document guide 210 which in a lowered position deflects an incoming document 200 by being forced by roller 216 under the deflector guide. The leading edge of a curled or damaged or deformed document (or the uncurled leading edge if the document is flat) are deflected by a document guide essentially smoothed-faced underside surface 217 and thus guide the leading edge 200*b* of the document into the nip 204. A tab 219 depends from near a distal end of guide 210 and rides on an edge of the print platen 203*a* (FIG. 16) of the printing station and functions as a down stop of the document guide 210. The document guide has a first long portion 213 which in a scanning mode position is parallel to the platen of the printing station and in position to guide a document (curled or uncurled) into the nip 204, an integral short portion 211 and a pivot 212. Arrow 220 in FIG. 17 denotes the document feed direction. The documents are constrained at their top surface by the underside 217 of the document guide and at their bottom surface by the print platen 203*a*.

Sheets which are to be printed on are clean virgin sheets without curl and thus there is no need to guide or constrain the print sheets to the common output nip. Sensors (not shown) in the document tray 201 and in the sheet feed path 199 indicate if a document is to be scanned or a sheet is to be printed. Rollers 218 are provided as part of a wet paper stacker (not shown) which functions to force the edges of the printed-on sheets to go up causing a sheet stiffness so that the sheet more accurately drops into a bin allowing for more dry time of the previous sheet.

Figure 16:
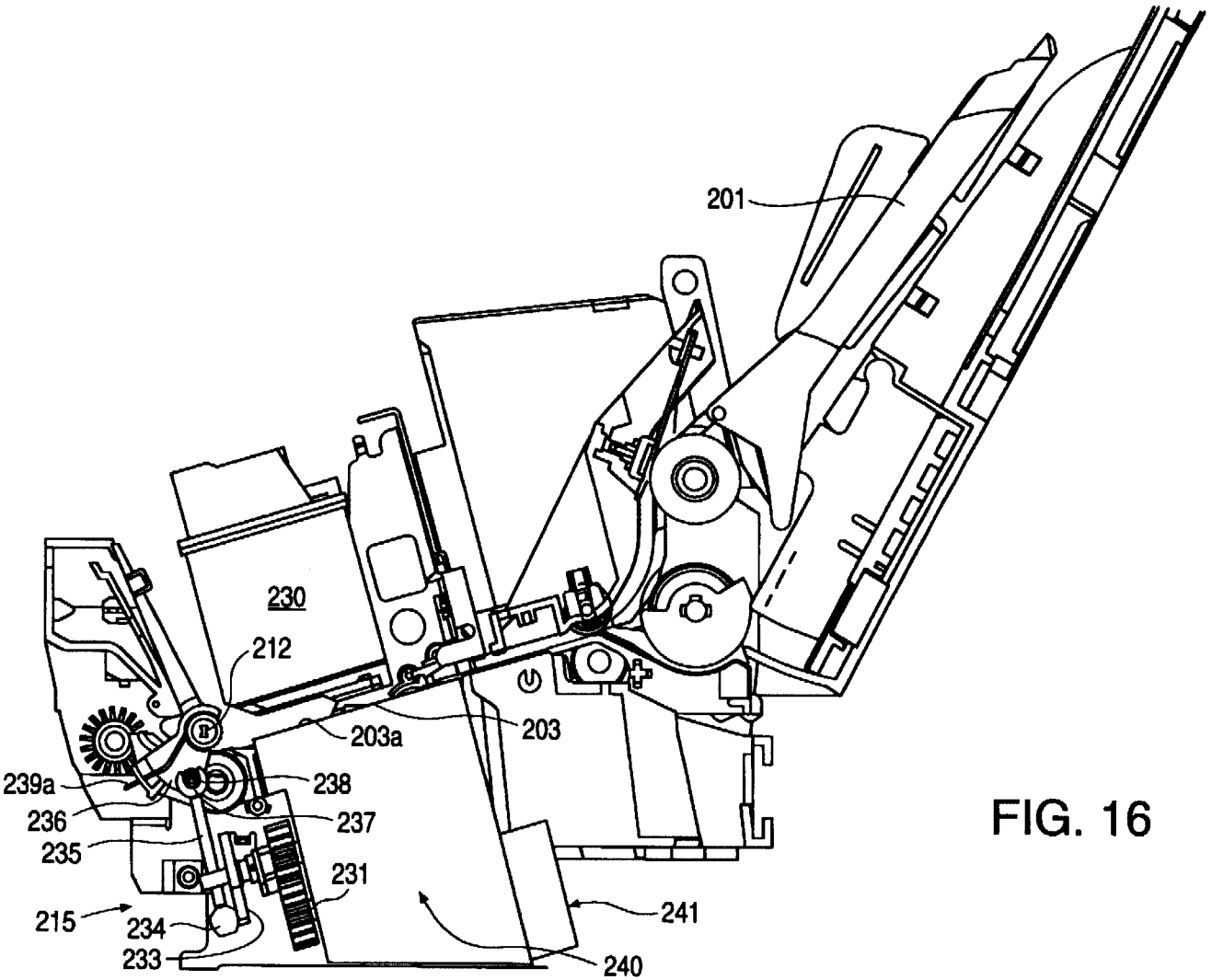
FIG. 16 is a schematic side view of the common paper path showing the document guide in a raised position allowing the print cartridge to be horizontally moved into a printing mode position.
Figure 17:
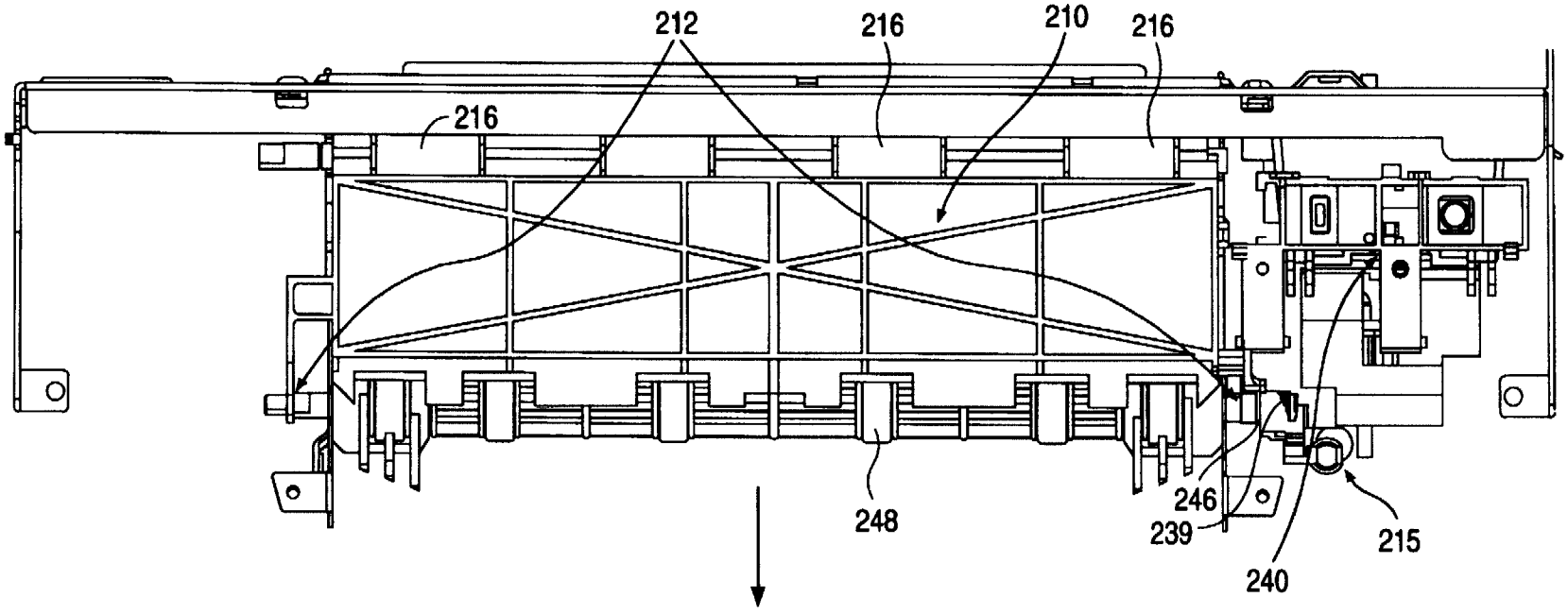
FIG. 17 is a top view of the printer station with the document guide in a scanning mode position.
Figure 18:
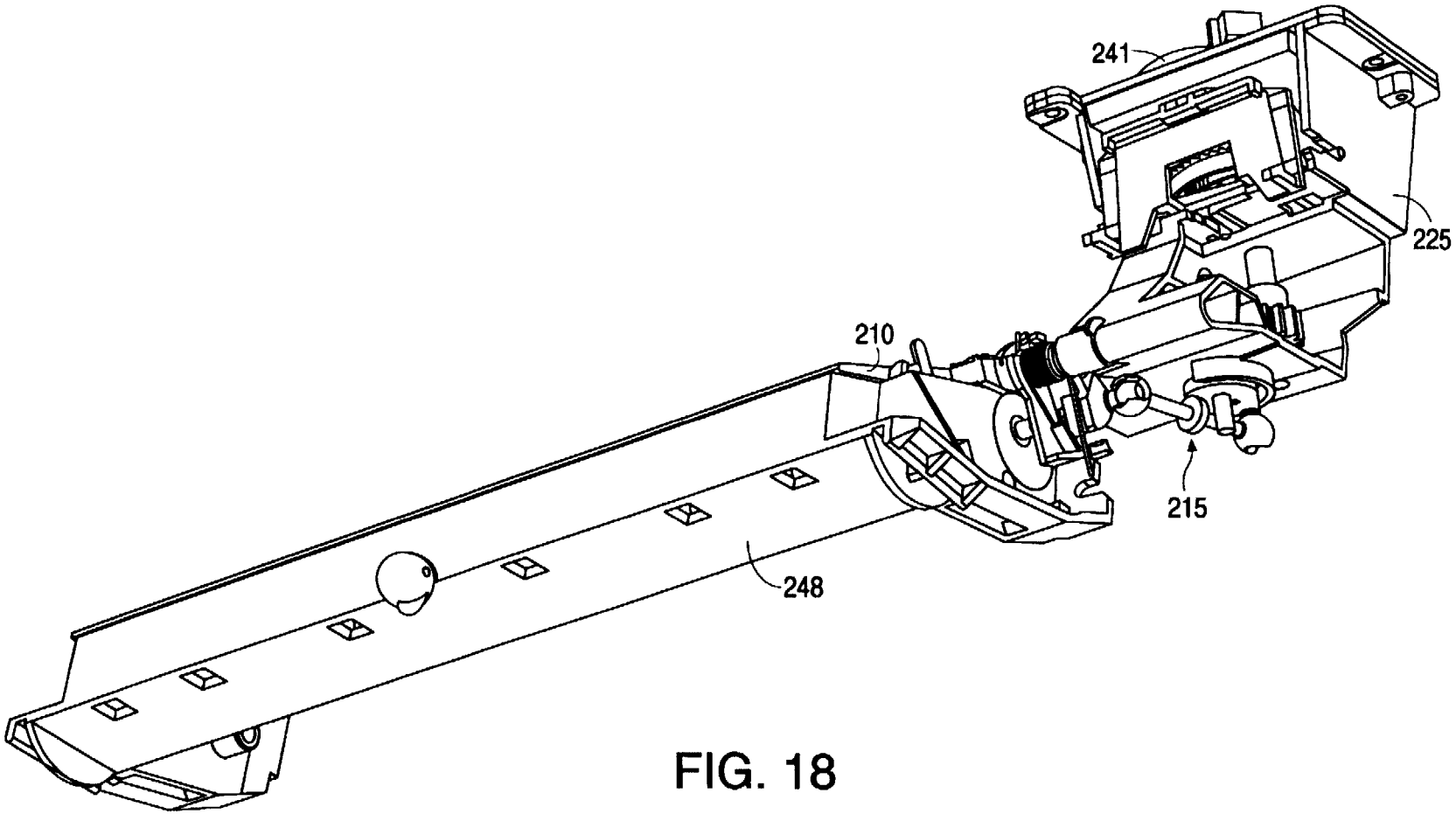
FIG. 18 is a perspective front top right hand view of the service station (less sled) showing the linkage to the document guide, sometimes called a document deflector or flapper.
Figure 19:
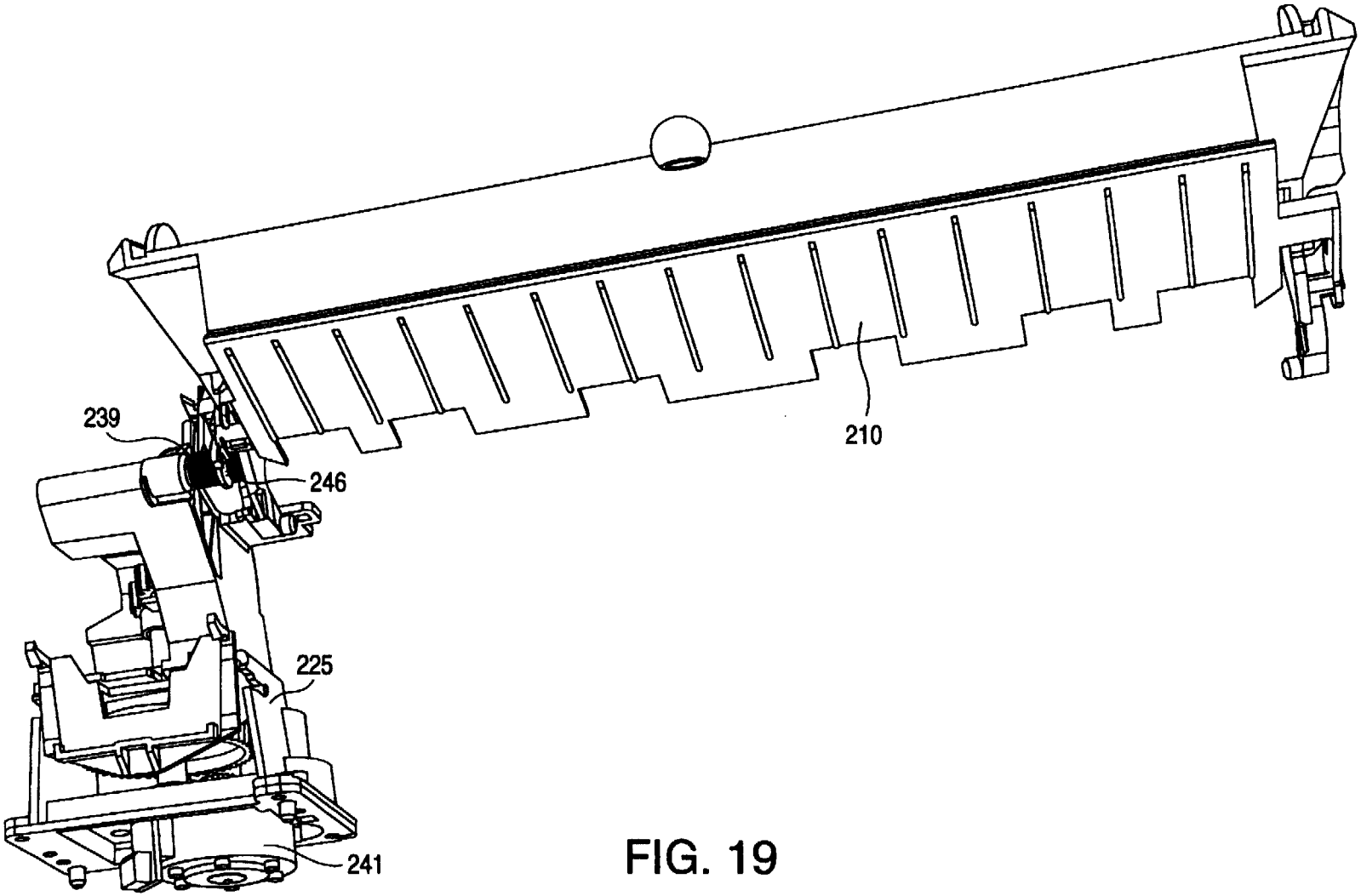
FIG. 19 is a perspective top back view thereof.
Figure 20:
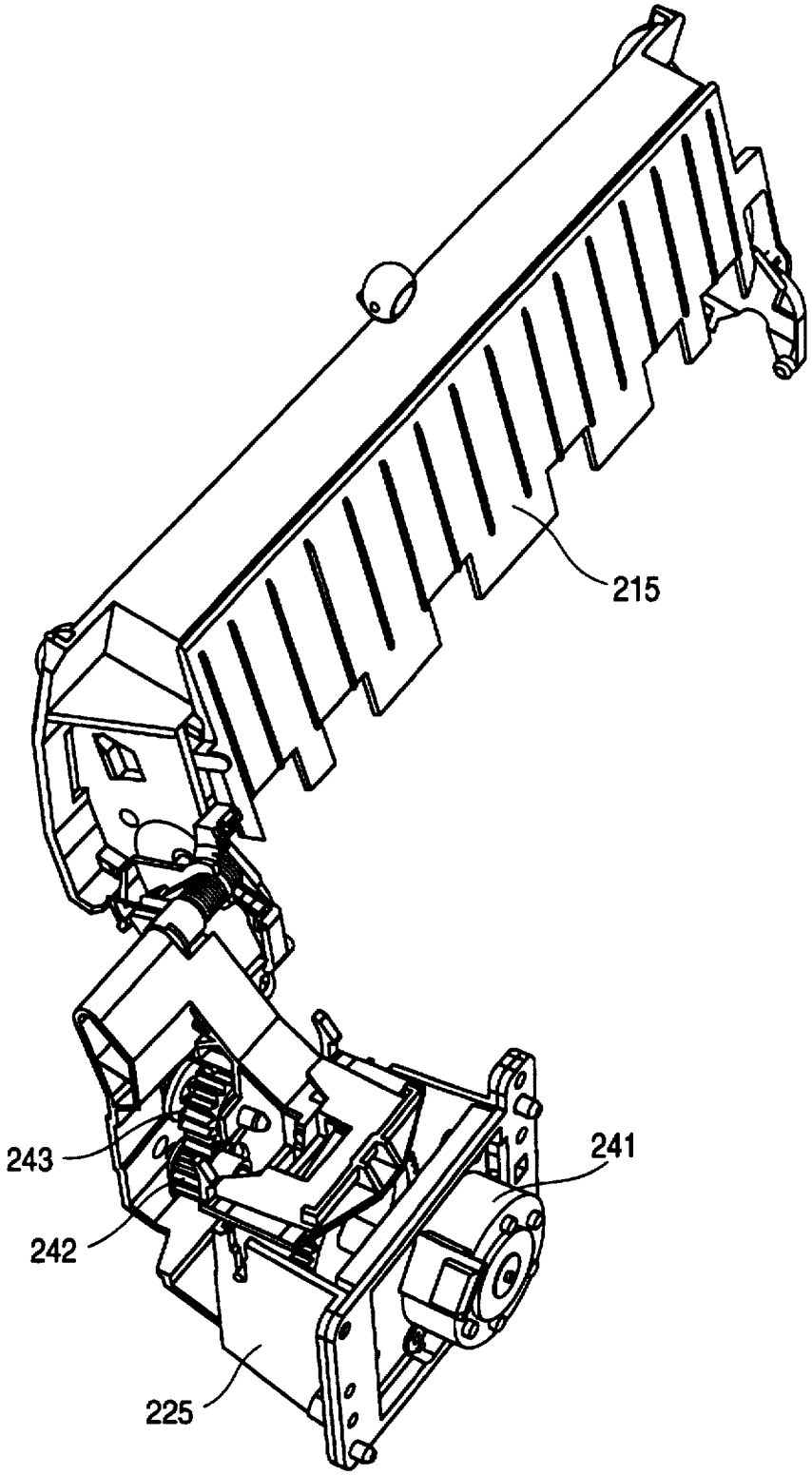
FIG. 20 is a perspective top right back view thereof.
Figure 21:
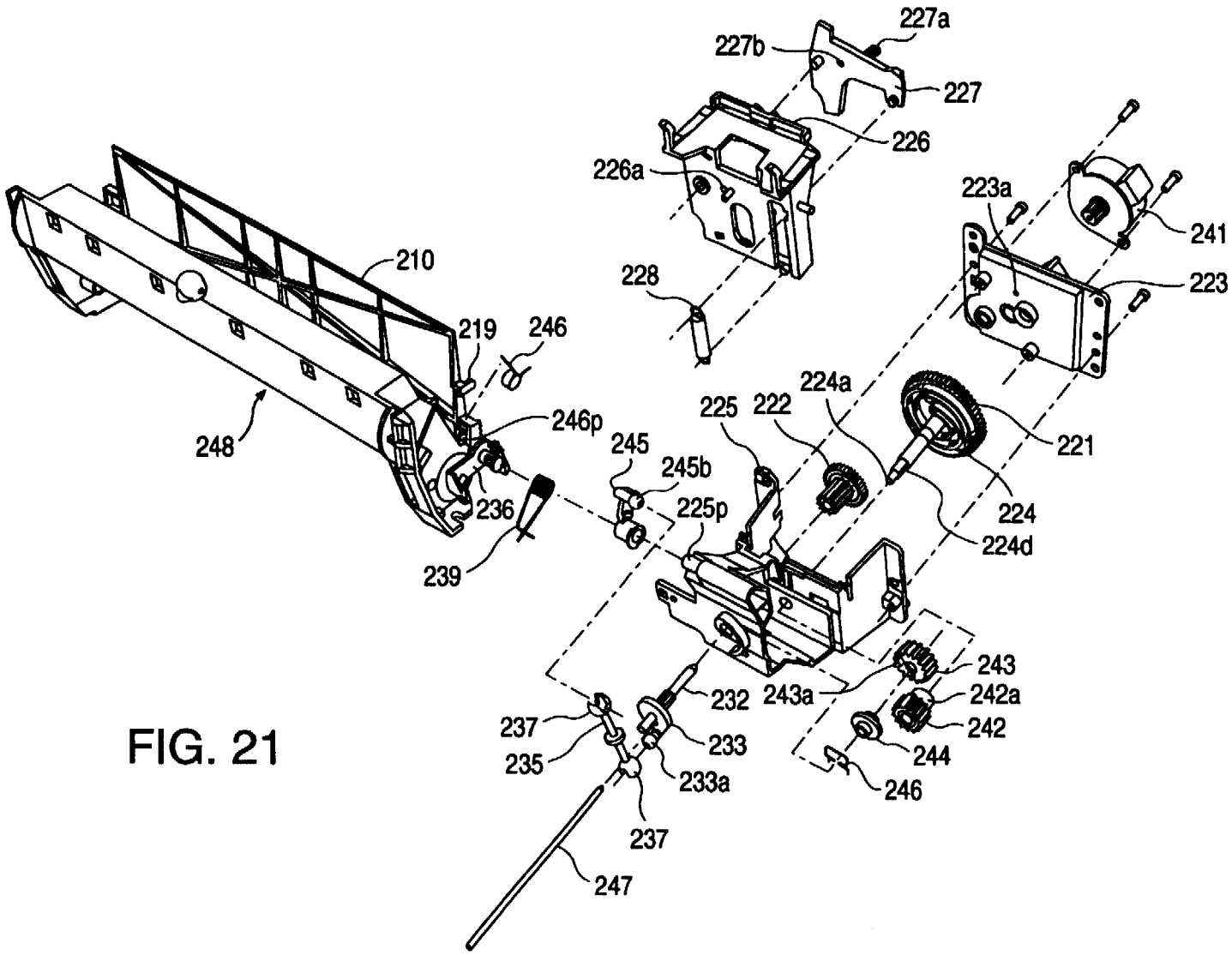
FIG. 21 is an exploded view thereof.

As seen in FIGS. 15 and 16 a mechanism is provided to rotate and lower the document guide clockwise about 100° to 110° for a scanning mode of operation after a printing mode of operation has been completed, with the print cartridge slid away from the printing station or zone. Thereafter, a coil spring 246 (shown in FIG. 22 but obscured in FIGS. 15 and 16), which has been spring loaded by the rotary movement, returns, by the spring bias, the document guide 210 back to the raised position shown in FIG. 15. This is required to allow for the print cartridge 230 (FIG. 16) to be moved into close proximity to the paper sheet. The document guide is rotatively movable about the pivot 212 which provides a center of rotation. Actuation is provided by a linkage 215 between the document guide and the print cartridge capping and wiping system 240 (FIGS. 16 and 17). The invention makes use of a dwell state in the capping function where the capping and wiping system motor 241 continues to rotate after the print cartridge has been capped. This extra motion is connected to gear shaft 231 (FIG. 16) to the linkage 215 and is just long enough to raise the document guide when rotating the capping system motor in one direction or lower it when rotating in the other direction.

The linkage 215 includes a document guide drive shaft 232 which rotates a lever arm 233 containing an offset ball crank 234 from the position shown in FIG. 16 to the position shown in FIG. 15 by moving a push rod or ball link 235 having a fork end 237 pushing on a fixed pin 238 on a pivot plate 236, which end rotates the pivot plate 236 fixedly or integrally connected to the document guide 210 clockwise to pivot the document guide to its down position to scan documents or counterclockwise (looking at FIG. 16) to its raised position in FIG. 16, permitting the print cartridge 230 (FIG. 16) to be moved laterally into the print station 203.

FIGS. 18–29 illustrate the details of a cam and cam follower subsystem in the service station for driving the document deflector (flapper) including linkage 215. Referring to FIGS. 18–21 particularly FIG. 21, the service station actuation and document deflector (flapper) actuation are both accomplished with one motor 241 which preferably is a low cost stepper motor attached to back plate 223. A reduction gear (idler gear) 222 is used to generate the required torque. This reduction gear then drives the cam 221. The cam has a raceway 224 (see FIG. 26) in its face in which a pin 227*a* in the follower 227 is engaged. At −10 degrees from the rest position of the cam the follower pin hits the end of the raceway in the cam. This is used to initialize the stepper motor. The cam then rotates +10 degrees to be in the rest position. As the cam rotates the raceway spirals out according to the "Cam Radius" in the attached table (FIG. 30) "New and Improved Service Station & Flapper Timing". The follower pin can be in three primary positions (if not translating between them). The follower is spring loaded with spring 228 into the carrier 226 which carries a sled (not shown) mounting the cappers and wipers for needed print cartridges servicing. This spring load allows the carrier (that carries the capping boots) to cap the pens (not shown) with the correct amount of force when the cam is at the correct position.

The snout 224*a* of the cam sticks into the flapper actuation area of the housing 225. The housing positions all the cam and gear mechanisms. The cam snout has a D shaft 224*d* which mates with a D hole in the 13 tooth base gear 242. This D connection ensures that the teeth on the 13 tooth base gear 242 are aligned with the raceway on the cam. Now as long as the cam is aligned with the rest of the mechanism the 13 tooth base gear will be as well. Note that there is a shroud 242*a* on one end of the 13 tooth base gear that physically prevents it from being installed the wrong way. This ensures that the teeth are in the proper orientation relative to the raceway on the cam. The 13 tooth base gear 242 is in mesh (FIG. 20) with the 16 tooth top 243. There is a stop 243*a* (FIG. 23) on the face of the 16 tooth top gear that hits the bar 244*b* (FIG. 23) on the keeper bottom crank 244 when the cam has rotated 360 degrees from its rest position. The cam therefore goes through a total of 370 degrees (10° for initializing +360° during service station actuation) before the stop 243*a* of the 16 tooth top gear hits the bar 244*b* on the keeper bottom crank 244. The 16 tooth top gear 243 can rotate significantly less than 360 degrees without its stop hitting the bar on the keeper. Due to the thickness of the stop on the 16 tooth top gear and the thickness of the bar on the keeper bottom crank the 16 tooth top gear can only rotate 300.625 degrees without its stop hitting the bar on the keeper bottom crank in either direction. This is the reason for the gear reduction between the 13 tooth base gear and the 16 tooth top gear. This 13/16 ratio allows the cam to turn its full 370 degrees during service station actuation before the stop on the 16 top gear hits the bar on the keeper bottom crank.

Figure 24:
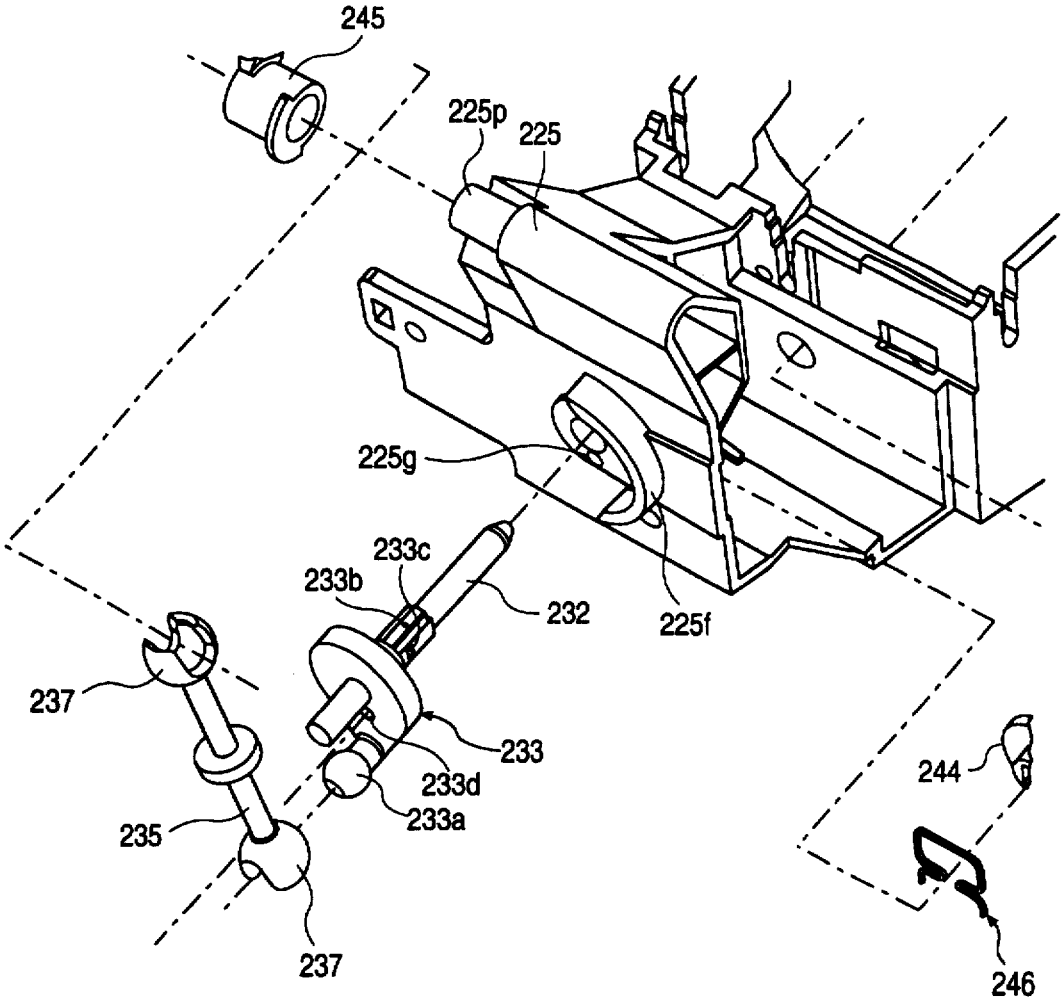
FIG. 24 is a exploded perspective view of the interconnection between the service station and the document deflector.

The keeper bottom crank 244 is keyed 244*c* (FIG. 23) onto a crank bottom or lower arm 233 with a square shaft and key 233*b* (FIG. 24). The keeper bottom crank has two holes 244*d* (FIG. 23) that allow legs from the spring keeper 246 to protrude through into the square interior hole. There are mating detents 233*c* in the square shaft of the crank bottom 233 (FIG. 24). During assembly the crank bottom is inserted through the main housing of the mechanism, keeper bottom crank, and the gear 16-tooth top. The legs from the spring keeper 246 snap into the detents in the shaft of the crank bottom securing the crank bottom into the assembly.

The housing acts as the bearing journals for the crank bottom 233. The crank bottom acts as a shaft for the 16 tooth top gear to spin on.

Figure 25:
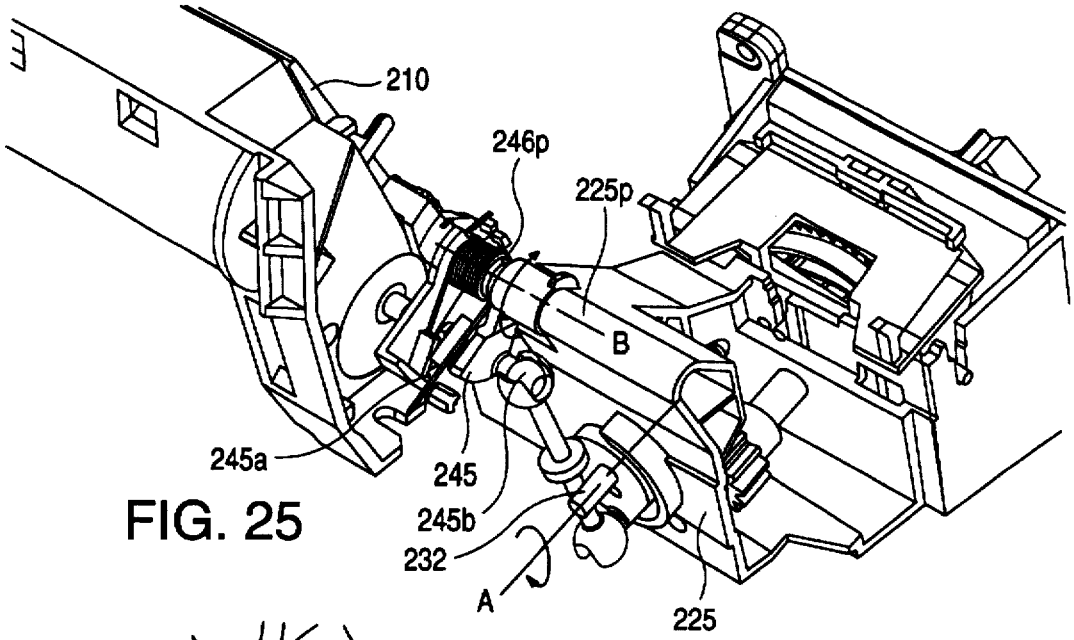
FIG. 25 is a detailed perspective view of part of the interconnection between the service station motor shaft and document deflector shaft shown in FIG. 18.
Figure 28:
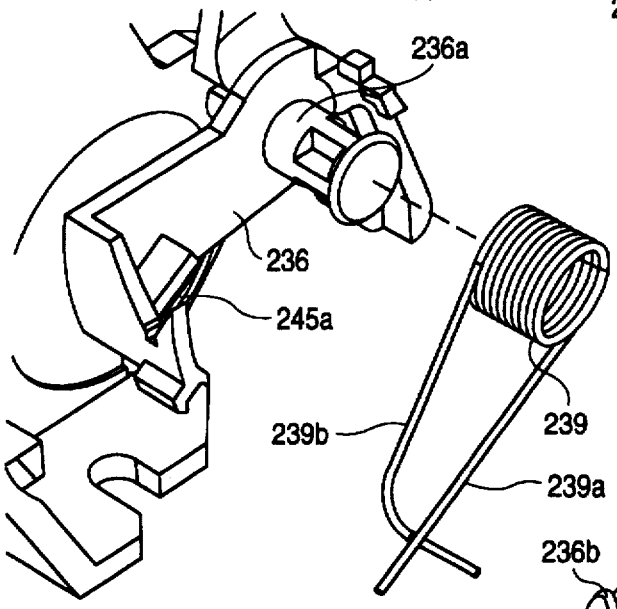
FIG. 28 is a detailed exploded perspective view of the down spring prior to assembly to the document deflector extension arm or pivot plate.
Figure 29:
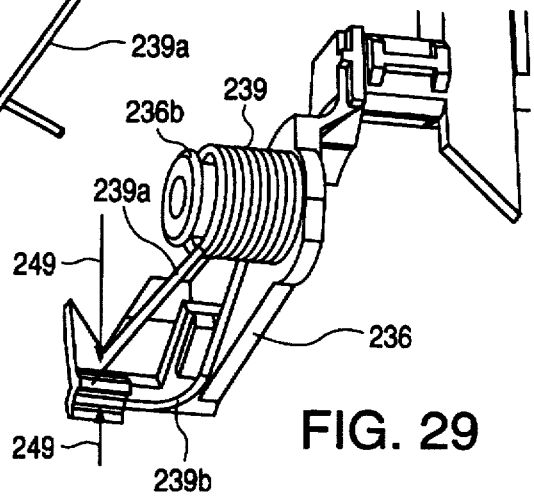
FIG. 29 is a detailed view of the down spring in assembled position.

The front of the crank bottom 233 has a ball 233*a* on it. The ball link or push rod 235 has receptacles 237 on both ends. The bottom receptacle of the ball link is snapped over the ball 233*a* on the front of the crank bottom. The upper receptacle snaps over a ball 245*b* on the flapper follower 245 (FIG. 25). The flapper follower 245 rotates on a post 225*p* of the housing duplex 225 significantly above the crank bottom. The axis of this post is also not parallel with the axis of the crank bottom. The ball joints on either end of the ball link allows it to transfer partial rotation between these non-parallel, non-intersecting shafts. The document guide drive shaft 232 extends along axis A while the deflector pivots about the deflector pivot 246*p* on axis B. Therefore when the crank bottom rotates 156 degrees from its lower position to its upper position the flapper follower rotates about 113.7 degrees. This difference in travel is due to difference in moment arm lengths and the three dimensional travel of the ball link. It should be noted that the sine error that is inducted to the ball link by the crank bottom is canceled out by the almost equal and opposite sine error the flapper follower goes through. This results in smooth motion at the flapper follower even though the ball link travels in a complex three dimensional sinusoidal pattern.

The flapper follower 245 (FIG. 22) has a rib 245*a* on a portion of its barrel 245*b* that allows it to mate with a slot 225*a* on the housing 225. The flapper follower is rotated to a position which it will not see during operation of the product, it is then installed over the post on the housing then rotated down so that the rib catches in the slot on the housing. It then continues to rotate to snap its ball into the top forked ball receptacle 237 of the ball link. Once snapped onto the ball link the flapper follower cannot rotate back far enough to disengage the rib from the slot.

All of the parts mentioned to this point are part of the service station assembly. The flapper 210 (document deflector) is mounted on the star wheel assembly 248 shown in FIG. 21. The intention is for these assemblies to be as modular as possible. The modular approach allows different assemblies to be assembled by different contract manufacturers then easily assembled to the top level product.

The interface between the service station assembly and the star wheel assembly is through the flapper follower 245 to the down spring 239 (also shown in FIG. 15). The down spring 239 hooks down into a slot 245*a* (FIG. 25) on the flapper follower during top level assembly. This hooking is in the same direction that the star wheel chassis installs to the top level so when the star wheel assembly is installed the down spring is automatically hooked onto the flapper follower. This provides the modular interface between these two assemblies. When the flapper follower is rotated by the ball link, as described above, it also rotationally pushes on the down spring that is hooked over it. This in turn rotates the flapper 210 down. If something is blocking the travel of the flapper down, or a user manually lifts it, all that happens is that the down spring winds up. The maximum force exerted on the mechanism is the torsion windup force of the torsion down spring. The down spring winding up prevents any damage from occurring to any of the parts. If the opposite scenario occurs, the flapper is manually forced down by a user, all that happens is the down spring comes unhooked from the flapper follower. In this case no force is exerted on any of the mechanism which could damage it. When the force is removed the flapper returns up until the down spring is again hooked into the flapper follower.

The flapper follower is driven past where it would normally need to be driven to drive the flapper all the way down. The flapper rotates down to its down position then a stop 219 on the flapper hits the platen 203 (FIG. 15). The platen is what the paper rides on through this section of the machine. The flapper stop touching the platen ensures the most accurate flapper-to-paper distance as there are no other parts involved in the tolerance loop. The flapper follower continues to drive farther which merely winds up the down spring. Nominally the flapper follower rotates from 116.5 degrees to 124.477 degrees after the flapper stop hits the platen. In reality all the slop and tolerances are taken up in this over-travel.

On the way back up the flapper follower rotates from the flapper down position to the flapper up position. At 13.5 degrees the flapper follower nominally unhooks from the down spring and rotates farther to 10.7825 degrees. This amount of over-travel is to again take up tolerances. This ensures that when the flapper follower is up the flapper is always all the way up despite the tolerances, slop, and other machine-to-machine variances.

Figure 22:
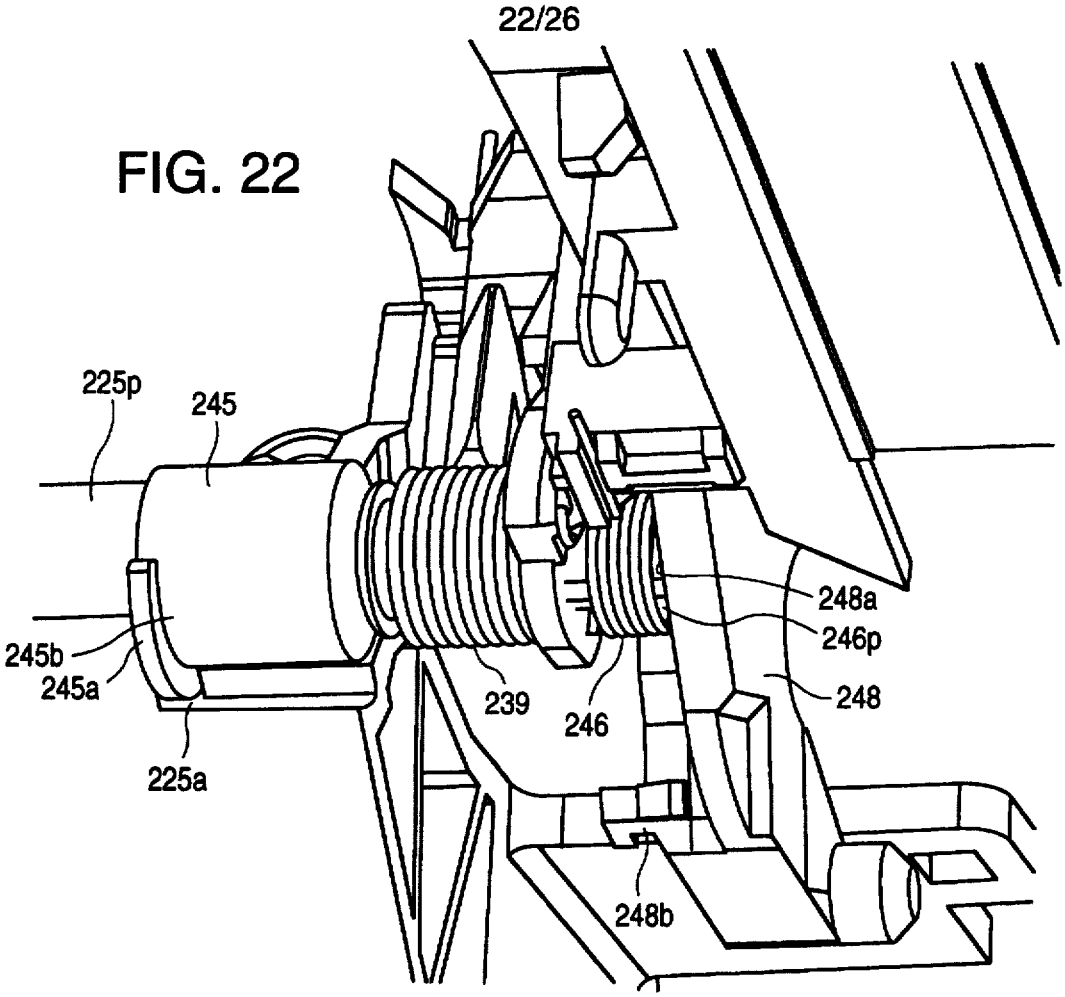
FIG. 22 is a detailed perspective view of the document deflector follower extending from the service station housing.
Figure 23:
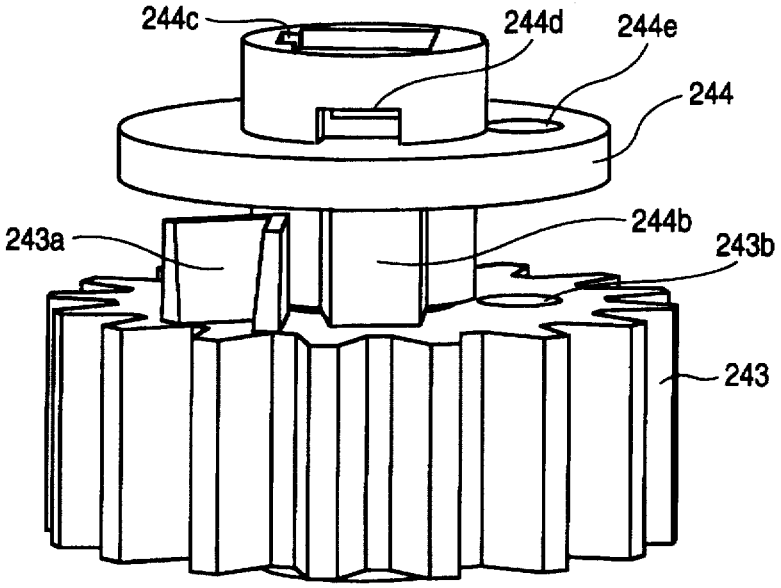
FIG. 23 is a detailed perspective view of the interface between a keeper bottom crank and a document deflector drive gear.

The flapper is returned back up by the up spring 246 (FIG. 22). Spring 246 is a torsion spring that mounts over the pivot 248*a* of the flapper on the star wheel chassis 248. One leg pushes on the star wheel chassis and the other leg pushes the flapper up. This would typically be a difficult assembly to assemble-having to wind up a torsion spring then maintain its prewind while installing another part over the same post is almost impossible. To solve this problem an assembly hook 248*b* is provided on the star wheel chassis for the loose end of the up spring 246. The up spring is loaded on its post 248*a* and wound up, the free end is then hooked over the assembly hook 248*b* on the star wheel chassis. The assembler's hands (and area around the pivot) are free to concentrate on assembling the flapper over the pivots on the star wheel chassis. After the flapper is properly installed on its pivots the up spring can be unhooked from the assembly hook on the star wheel chassis and allowed to act on the flapper as functionally intended. The assembly hook is beyond the operating travel of the up spring so it does not interfere with the operation of the unit. Angled arms 239*a* and 239*b* (FIG. 29) of down spring 239 are connected to first plate or extension arm 236 of the deflector such that deflector forces (arrows 249) from the down spring act straight through the extension arm so that no torque is imposed on the extension arm. Down spring 239 is mounted on post 236*a* and held thereon by annular ring 236*b*.

The up spring pushing the flapper back up also ripples down the flapper follower, ball link, crank bottom, keeper bottom crank, and 16 tooth top gear whose returns is regulated by the rotation of the cam. If something catches or binds in this train of events the stop on the 16 tooth top gear will simply pull away from the bar on the keeper bottom crank. This has to be allowed to allow the dwell described above. To resolve this issue the stepper motor is continued to be driven all the way back to the initialization point. This causes the stop on the 16 tooth top gear to rotate all the way around and hit the back side of the bar on the keeper bottom crank. This will forcibly return a train of parts that has been caught.

The initialization procedure for this system may be called a "U-turn". A standard system that uses a stepper motor must initialize it since stepper motors do not know their own shaft position, they can only be incrementally driven. Without encoders, end of travel switches, or other position sensors a stepper motor must be driven into a stop the full expected number of steps that it could be expected to be lost during initialization. This is almost always the full travel of the system. This driving the stepper motor into a solid stop results in a very loud, objectionable rattling type noise. The "U-turn" initialization procedure is different in that it expects where the stepper motor will likely be when the machine is powered back up. In the present invention with the service station in the capped position, 584 steps are provided according to the "New and Improved Service Station & Flapper Timing" chart FIG. 30. Upon initialization a drive up to 899 steps is made which just kisses the upper initialization stop. A drive is made back down to 0 steps to kiss up against the lower initialization stop. One can then drive back to 584 steps and thus leave the service station in the capped position. The beauty of this procedure is that if the stepper motor is in its expected position (which it will be in a vast majority of cases) the initialization procedure only softly kisses the two initialization stops rather than violently banging against one. So in a vast majority of cases the initialization procedure will be very quiet (only be able to hear the well controlled movement of parts through their normal operating range). In a case where the stepper loses its position, it will either hit the upper or lower initialization stops during the "U-turn" and thus only have to slip the number of steps that the motor has lost. In a vast majority of cases where a stepper motor is lost this is only a couple of steps, so again this is much quieter than the typical initialization that involves slipping the stepper motor the total number of steps that it can travel.

As used herein, a first dwell is provided between steps 32 to 576 when the service station is active and the document deflector is inactive. A second dwell occurs between steps 592 to 871 when both the service station and document deflector are inactive. A pre-travel dwell is provided between steps 0 to 32 since no action happens in either the service station or document deflector. Post-travel dwell occurs between steps 871 to 899 where both the service station and the document deflector mechanisms are inactive.

As mentioned before the timing of the flapper actuation mechanism is critical. There are four main areas that timing can be incrementally off.

Figure 26:
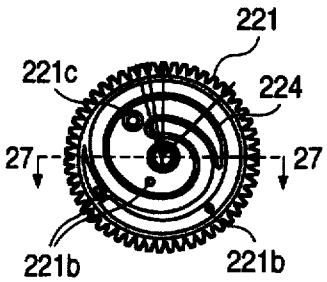
FIG. 26 is a front view of the cam.
Figure 27:
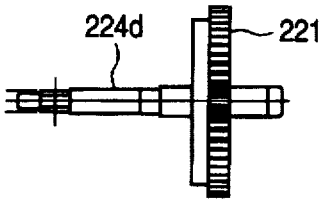
FIG. 27 is a side view thereof taken on the line 27—27 of FIG. 26, additionally showing the cam shaft.

1. The post 227*a* on the follower 227 (FIG. 21) that fits in the raceway 224 on the cam 221 can be mis-installed either into the wrong raceway or in a dead area in-between the raceways 221*b*. The reason it can be installed in the wrong raceway is that the raceway extends for 586.3 degrees. See "New and Improved Service Station & Flapper Timing" chart (FIG. 30). For most rotational orientations there is then two different raceways the pin could be inserted into, e.g. at 0 degrees the pin could be inserted at the cam radius of 5.5 mm or 15.1 mm (since 0 degrees and 360 degrees are rotationally identical). If the pin was installed in the wrong raceway the flapper could be actuating when it was intended to be inactive, this would cause a pen crash into the flapper. Ejector pins 221*b* may be provided as indicated in FIG. 26.
2. The 13 tooth base gear 242 and the 16 tooth top gear 243 could be meshed incorrectly. Again this would result in the flapper actuation and service station actuation overlapping resulting in a pen crash into the flapper.
3. The crank bottom 233 and keeper bottom crank 244 could be off one rotation relative to the 16 tooth top gear 243. Basically this means the stop 243*a* oh the 16 tooth top gear was installed on the wrong side of the bar 244*b* on the keeper bottom crank 244 (FIG. 23).
4. The crank bottom could be rotationally slightly off which would allow the ball link to be installed over center on the wrong side of the centerline of the crank bottom.

The solution to timing problem number 4 is to mold a flange 225*f* out the front of the housing which created a keep out-zone flange (FIG. 24). This keep out zone prevents the crank bottom from being in a position in which it could be over center on the wrong side. The existence of this flange then lends itself to function also as the initialization stops for the crank bottom. The upper stop is used in the "U-turn" initialization routine and the lower stop is coincident with the lower end of travel in the cam. The slop in the system then dictates that the lower end of travel of the cam is used as the lower stop even though they are nominally coincident. This causes no adverse effects and yet ensures the keep out zone as described.

Alignment 1, 2, and 3 are resolved with the use of a timing skewer 247 (FIG. 21) during assembly. The timing skewer penetrates alignment holes 233*d*, 225*g* (FIG. 24), 244*e*, 243*b* (FIG. 23), 227*b* (FIG. 21), 221*c* (FIG. 26), 226*a* and 223*a* (FIG. 21) molded in the crank bottom, chassis, keeper bottom crank, 16 tooth top gear, follower, cam, carrier and back plate, respectively. These timing holes are all located while the parts are in the rest position (0 degrees of cam rotation). The above timing problems are therefore resolved in the following fashion:

1. The skewer penetrating the alignment holes in the duplex, cam, carrier, and follower ensure that the pin in the follower is in the correct raceway of the cam. It also ensures that the follower and carrier are properly assembled together and installed all the way into the duplex.
2. The D alignment of the 13 tooth base gear and cam previously discussed ensures that the 13 tooth base gear and 16 tooth top gear are in proper alignment when the skewer penetrates the duplex, 16 tooth top gear, and the cam. The coarseness of the 13 tooth base gear and 16 tooth top gear facilitates proper tooth alignment, they are a module 1.0 tooth form (25.4 pitch). If they were off by one tooth the angular error would be large enough that the skewer could not be inserted.
3. The skewer penetrating the crank bottom, duplex, keeper bottom crank, and the 16 tooth top gear ensure that the stop on the 16 tooth gear was not installed on the wrong side of the bar on the keeper bottom crank.

The skewer is used during assembly while assembling all the parts, therefore the above three solutions happen simultaneously. Also the skewer ensures all the parts are fully seated and would highlight any part problems.

While specific illustrated embodiments have been shown and described, it will be appreciated by those skilled in the art that various modifications, changes and additions can be made to the methods, structures and apparatus of the invention without departing from the spirit and scope of the invention as set forth in the following claims.

We claim:

1. A multiple-function printer comprising:

a document feeder for holding a stack of documents to be scanned at a scanning station during a scanning mode of operation;

a sheet feeder for holding a stack of sheets to be printed on at a printing station during a printing mode of operation, the scanning station and said printing station being in a common paper path;

said printing station including at least one print cartridge each containing a printhead, and a service station for periodically capping and wiping the printhead or printheads;

a sheets and documents output station in said common paper path;

a document deflector movable with respect to the output station and positioned in an operational mode for constraining a surface of document pages exiting from the scanning station to the output station; and wherein said service station includes a motor for said capping and wiping and wherein said motor further actuates said document deflector to drive the document deflector into the constraining operational mode when said printhead or printheads are capped.

2. The printer of claim 1 wherein said motor is a stepper motor.

3. The printer of claim 1 wherein said service station further includes a cam having a cam surface and a cam follower, said cam follower being positionable on said cam surface in a dwell position, a wiping position and a capping position, said document deflector being driven to the constraining operational mode during a dwell position.

4. The printer of claim 3 wherein said cam includes a shaft;

a first gear mounted to said shaft and in timed relation to said cam;

a second gear engaged with a said first gear, said second gear having a stop extending from a side surface of said second gear;

a keeper crank including a stop bar, said stop being engageable with said stop bar; and a ball link extending between said keeper crank and said document deflector for rotating said document deflector into the constraining operational mode.

5. The printer of claim 4 further including a document deflector follower and a down spring connected between said deflector follower and said document deflector.

6. The printer of claim 5 in which a sine error from the keeper crank imparted on the ball link is compensated for by an equal and opposite sine error of the deflector follower.

7. The printer of claim 5 wherein the down spring is hooked to said deflector follower such that when the deflector follower is rotated by said ball link, the deflector follower rotationally pushes on the down spring to rotate the deflector down.

8. The printer of claim 4 wherein said cam surface, said cam follower, said first gear, said second gear and said keeper crank each include an alignment hole, and further comprising a skewer penetratable into said alignment holes where said alignment holes are aligned to ensure that said cam follower is correctly placed in said cam surface and said gears are properly aligned.

9. The printer of claim 1 wherein said motor is gear connected to a document guide drive shaft and said document deflector has a deflector pivot which is non-intersecting and non-parallel to said document guide drive shaft; and including a connection linkage between said document guide drive shaft and said deflector pivot, said linkage comprising a keeper crank and a ball link.

10. The printer of claim 1 further including means for manually moving said document deflector from or to the constraining operational mode.

11. The printer of claim 10 wherein said means for manually moving comprises a pivot arm extending from one end of said document deflector and a deflector follower; a down spring connected to said pivot arm such that when said document deflector is manually lifted and then released the document deflector is spring-pressed from and to a constraining operational mode and when the document deflector is manually pushed down the down spring unhooks from the deflector follower.

12. The printer of claim 1 wherein said service station further includes a cam surface and a cam follower, said cam surface and cam follower having a first dwell during which said service station is active and said document deflector is inactive, and a second dwell during which said motor drives said document deflector into an active mode, and said service station is inactive.

13. The printer of claim 12 further including a pre-travel and post-travel dwell in said cam surface such that a cam follower interface between said service station and said document deflector accounts for tolerances in said interface.

14. The printer of claim 1 wherein said output station includes a pair of stops to provide accurate positioning of said document deflector in the constraining operational mode and a non-constraining operational mode.

15. The printer of claim 1 further including a document deflector pivot mechanism for driving said document deflector, said pivot mechanism including a down spring post, an annular ring on the spring post, a torsion down spring including spring coils loaded over said ring and wherein said down spring is adapted to be wound up to a functional position such that the spring coils contract to confine the down spring on said spring post.

16. The printer of claim 15 wherein said document deflector includes an extension arm and said down spring includes an angled arm bent at one end at an angle such that when said angled arm is loaded on said document deflector forces from said down spring act straight through said extension arm such that no torque is imposed on said extension arm.

17. The printer of claim 16 in which said angled arm is bent at one end at an angle orthogonal to the angled arm such that in a loaded state the angled arm and bent end form a 90° angle.

18. The printer of claim 15 wherein said pivot mechanism further includes an up spring for returning the document deflector to a non-constraining operation mode.

19. The printer of claim 1 further including a deflector follower and a down spring connected to said document deflector, said deflector follower positioned to depress the down spring to force the document deflector into the constraining operation mode.

20. The printer of claim 19 wherein said deflector follower includes a barrel having a rib and said service station includes a housing having a slot, said rib being engageable in said slot.

21. The printer of claim 1 further including a pair of motor stops; and wherein said motor is a stepper motor drivable to each of said stops upon initialization of said motor when said service station is in a capped position and thereafter the motor is returnable to the capped position and then movable to actuate the document deflector into the operational mode for constraining the surface of the document pages exiting from the scanning station to the output station.

22. The printer of claim 21 in which one of said motor stops is a lower initialization stop at zero steps of the stepper motor and the other one of said motor stops is an upper initialization stop at 899 steps and wherein the motor is movable into a capped position at 589 steps.

23. The printer of claim 1 wherein said motor is gear connected to a document guide drive shaft and said document deflector includes a deflector pivot which is non-intersecting and non-parallel to said document guide drive shaft and wherein a ball and socket joint extends between said document guide drive shaft and said deflector pivot.

* * * * *